US005361090A

United States Patent [19]

Suzuki et al.

[11] Patent Number: 5,361,090

[45] Date of Patent: Nov. 1, 1994

[54] IMAGE RECORDING APPARATUS AND METHOD FOR MAINTAINING IMAGE QUALITY AFTER RECORDING INTERRUPTION

[75] Inventors: Akio Suzuki, Yokohama; Yasushi Miura, Kawasaki; Masami Izumizaki, Yokohama, all of Japan

[73] Assignee: Canon Kabushiki Kaisha, Tokyo, Japan

[21] Appl. No.: 186,886

[22] Filed: Jan. 26, 1994

Related U.S. Application Data

[63] Continuation of Ser. No. 112,232, Aug. 27, 1993, abandoned, which is a continuation of Ser. No. 770,534, Oct. 3, 1991, abandoned.

[30] Foreign Application Priority Data

| | | | |
|---|---|---|---|
| Oct. 4, 1990 | [JP] | Japan | 2-265064 |
| Nov. 28, 1990 | [JP] | Japan | 2-322444 |
| Nov. 29, 1990 | [JP] | Japan | 2-325999 |
| Nov. 30, 1990 | [JP] | Japan | 2-329516 |

[51] Int. Cl.[5] ..... B41J 29/377; B41J 2/01

[52] U.S. Cl. ..... 347/17

[58] Field of Search ..... 346/1.1, 140 R; 400/719; 347/17

[56] References Cited

U.S. PATENT DOCUMENTS

| | | | |
|---|---|---|---|
| 4,313,124 | 1/1982 | Hara . | |
| 4,345,262 | 8/1982 | Shirato et al. . | |
| 4,459,600 | 7/1984 | Sato et al. . | |
| 4,463,359 | 7/1984 | Ayata et al. . | |
| 4,558,333 | 12/1985 | Sugitani et al. . | |
| 4,704,620 | 11/1987 | Ichihashi | 346/140 R |
| 4,723,129 | 2/1988 | Endo et al. . | |
| 4,740,796 | 4/1988 | Endo et al. . | |
| 4,791,435 | 12/1988 | Smith | 346/140 R |
| 4,899,180 | 2/1990 | Elhatem et al. | 346/140 R |
| 4,947,194 | 8/1990 | Kyoshima | 346/140 R |
| 5,023,626 | 6/1991 | Kawamura | 346/140 R X |
| 5,107,276 | 4/1992 | Kneezel | 346/140 R X |

FOREIGN PATENT DOCUMENTS

| | | | |
|---|---|---|---|
| 0300634 | 1/1989 | European Pat. Off. | B41J 3/04 |
| 0401025 | 12/1990 | European Pat. Off. | B41J 2/165 |
| 59-123670 | 7/1984 | Japan . | |
| 59-138461 | 8/1984 | Japan . | |
| 9006852 | 6/1990 | WIPO | B41J 2/05 |

*Primary Examiner*—Joseph W. Hartary

*Attorney, Agent, or Firm*—Fitzpatrick, Cella, Harper & Scinto

[57] ABSTRACT

An image recording apparatus has a stand-by mode in which a recording operation is interrupted during recording for stand-by. The apparatus includes a recording head for recording on a recording medium, a head temperature detecting device for detecting the temperature of the recording head, a memory device for storing temperature information detected by the head temperature detecting device when recording in the stand-by mode is interrupted, a stand-by time counting device for counting an interruption time for recording operation in the stand-by mode, and a head driving controlling device for transmitting a driving signal to the recording head. The controlling device is responsive to a temperature stored in the temperature memory device and an interruption time calculated by the stand-by time counting device on resumption of a recording operation after it is interrupted and the apparatus is placed in the stand-by mode.

19 Claims, 17 Drawing Sheets

IMAGE RECORDING APPARATUS AND METHOD FOR MAINTAINING IMAGE QUALITY AFTER RECORDING INTERRUPTION

This application is a continuation of application Ser. No. 08/112,232 filed Aug. 27, 1993, now abandoned, which in turn is a continuation of application Ser. No. 07/770,534 filed Oct. 3, 1991, now abandoned.

BACKGROUND OF THE INVENTION

1. Field of the Invention

This invention relates to a recording apparatus for recording using a recording head and more particularly to a recording apparatus having a stand-by mode which interrupts and resumes recording during recording.

2. Related Background Art

As this type of recording apparatus, digital recording devices such as an ink jet recording type and a thermal transfer recording type have been well known so far.

Especially, an ink jet recording apparatus has merits such as easy coloring, and prevails as, for example, an output device, etc. for computer graphics.

FIG. 7 is a block diagram showing the constitution when the ink jet recording apparatus is used as an output device for computer graphics. In FIG. 7, numeral 101 is a host computer, numerals 102 and 104 are image signals, numeral 103 is an interface, and numeral 105 is an ink jet printer. Image data, which the host computer 101 has therein, is transmitted to the interface 103 as an image signal 102, and is once stored in a memory (not shown) in the interface 103.

The interface 103 converts the image data within the memory into such a form that can be processed by an ink jet printer, and then transfers it to the ink jet printer 105 as an image signal 104. The ink jet printer 105 records in accordance with the transferred image signal 104.

In the above constitution, the capacity of the memory, in the interface 103, is generally several megabytes to several tens of megabytes, but the amount of image data which the host computer 101 has may exceed this capacity sometimes. In such a case, the host computer 101 is capable of transferring data only for the capacity of the memory in the interface 103 and after finishing recording based on these data, further transferring the remaining data for recording based thereon.

At this time, the printer 105 records on the basis of the data from the interface 103, and interrupts carrying of the recording sheet and driving of the recording head to stand by until the next data is transferred. This enables the system with the above-mentioned constitution for recording an image to cope with a larger amount of image data than the memory capacity of the interface 103 for recording on the basis thereof.

The recording apparatus having a stand-by mode for interrupting such a recording operation had the following problem. That is, the density of an image to be recorded may be discontinuously different before and after the stand-by. This is undesirable from the stability point of view in recording, and the image quality will be noticeably impaired especially when the above-mentioned change in density occurs on the same recording sheet.

FIG. 8 is a diagram of a typical recording sheet when the above-mentioned stand-by state occurs while a sheet of recording sheet is being recorded. In FIG. 8, it is assumed that the recording width of a recording head, that is, the length of the range in which discharging orifices are arranged, is d in the ink jet type recording head, and the recording head records images by scanning in the X direction in FIG. 8. Although an image for 14 scans in total can be recorded on a sheet of the recording sheet shown in FIG. 8, the memory capacity of the interface 103 is assumed to have only five scans.

In such a case, recording is first continuously performed on a portion shown by A in FIG. 8, and thereafter the recording head enters a stand-by state until image data for a portion shown by B is transferred. After this transfer is finished, recording is continuously performed on the B portion, and thereafter the recording head enters the stand-by state again until the image data for a C portion is transferred. After this transfer is finished, recording is continuously performed on the C portion to finish recording on a sheet of recording sheet.

When the recording head continuously records, its temperature generally rises. For example, in the ink jet type recording head, a discharge energy generating element to discharge ink generates heat energy with discharging to raise the head temperature. Also in the thermal transfer type recording head, the heat generated by the heating element raises the head temperature. When the temperature thus rises, the ink viscosity lowers and the ink discharge increases to increase the recording density, for example, in the ink jet type recording head. Also in the thermal transfer type, the amount of ink to be transferred onto the surface increases to increase the density in the same manner.

However, once the recording head enters a stand-by state for recording, the temperature lowers, and the recording density may lower in recording immediately thereafter. This phenomenon is seen with different types of recording heads, and is noticeable especially in the ink jet type recording head in which a heater is caused to generate heat to boil ink and ink is discharged by the pressure of bubbles generated thereby.

Changes in the recording density when such an image as shown in FIG. 8 is recorded are shown in FIG. 9.

Since when recording is continuously performed as shown in FIG. 9, the temperature of the recording head rises little by little and the density increases as the temperature rises, the change in density is not noticeable. When, however, the recording stand-by state shown by points of time D and E in FIG. 9 intervenes, a change in density abruptly occurs with lowered temperature of the recording head. As a result, a problem occurs in the image to be recorded that the difference in density between portions recorded before and after such a stand-by state is very noticeable.

To reduce the above-mentioned change in density by keeping the head temperature before and after such a stand-by state within a fixed range, a method has been well known so far in which the recording head is provided with temperature detecting means such as a thermistor and a heat insulating heater and the heat insulating heater is driven in accordance with the heat temperature detected by the temperature detecting means to control the temperature. In addition to this, another method was also well known in which a fan is provided and is driven if the head temperature is higher than the preset temperature.

However, this type of temperature control is slow in response while the temperature is abruptly changing, and it is difficult to precisely control the temperature when the temperature comparatively abruptly changes as shown by the points of time D and E in FIG. 9.

Especially when one recording head is provided with one each of thermistor and heater to control the entire recording head to a fixed temperature, the ink temperature in the liquid channel, where the discharge energy generating element is disposed and the discharge energy is applied to ink, does not reach the predetermined temperature even if a temperature to be detected by the thermistor reaches a predetermined temperature. Recording in this state frequently leaves a difference in density. For this reason, in order to overcome this phenomenon, it is regarded as necessary to heat the ink in the liquid channel, which directly relates to discharging, to the predetermined temperature as fast as possible.

In the above-mentioned conventional image recording apparatus, however, when the recording head continuously prints, the head temperature mostly exceeds the predetermined temperature even if the fan is driven. When the head interrupts the recording and enters the stand-by state in this state, such a change in density as mentioned above still occurs because the recording head temperature continues lowering until the predetermined temperature is reached.

SUMMARY OF THE INVENTION

It is an object of the present invention to provide an image recording apparatus capable of obtaining an image whose density is less changed by interruption of recording.

It is a further object of the present invention to provide an image recording apparatus capable of obtaining a uniform image free from change in density even if the head temperature lowers during stand-by.

It is another object of the present invention to provide an image recording apparatus capable of obtaining a uniform image free from change in density in the actual picture by correcting the image signal even if the head temperature lowers during the stand-by.

It is an additional object of the present invention to provide a recording apparatus having a mode in which the recording head is placed in a stand-by state by interrupting the recording while an image is being recorded, capable of raising the recording element temperature to suppress the difference in density occurring before and after the interruption by driving the recording element for the recording head beforehand in accordance with the recording head temperature immediately before interrupting the recording, a duration for which the recording has been interrupted, etc. before resuming the recording after interrupting the recording.

In order to accomplish the above-mentioned object, an image recording apparatus having a stand-by mode, in which recording operation is interrupted during recording for stand-by, according to the present invention comprises, a recording head for recording on a recording medium, head temperature detecting means for detecting the temperature of the recording head, memory means for storing temperature information detected by the head temperature detecting means when recording in the stand-by mode is interrupted, stand-by time counting means for counting an interruption time for recording operation in the stand-by mode, and head driving controlling means for transmitting a driving signal, to the recording head, adapted to a temperature stored in the temperature memory means and an interruption time calculated by the stand-by time counting means on resuming after recording operation is interrupted in the stand-by mode.

Also in order to accomplish the above-mentioned object, an image recording apparatus capable of appropriately interrupting and resuming recording when driving a recording head to record an image, according to the present invention comprises temperature detecting means for detecting the temperature of the recording head on interrupting the recording, interruption time detecting means for detecting the record interruption time, and correcting means for correcting an image signal to be transmitted to the recording head in accordance with the detection results of the temperature detecting means and the interruption time detecting means on resting recording.

Also in order to accomplish the above-mentioned object, an image recording apparatus for interrupting and resuming the recording operation using a recording head in accordance with the input state of an image signal, according to the present invention comprises head temperature detecting means for detecting the temperature of the recording head, and controlling means for detecting the temperature of the recording head on interrupting and resuming the recording operation by means of the head temperature detecting means, and when resuming the recording operation, for correcting the input image signal in accordance with a difference in temperature of the recording head between on interrupting and on resuming the recording operation.

Further in order to accomplish the above-mentioned object, an image recording apparatus equipped with a recording head for recording an image and temperature controlling means for detecting the temperature of the recording head and controlling the temperature within a predetermined range, according to the present invention comprises memory means for storing the temperature of the recording head on interrupting the recording, and resuming means for controlling the temperature controlling means so that the temperature of the recording head is almost equal to a temperature of the recording head when the record, which has been stored in the memory means, is interrupted on resuming after the recording is interrupted.

DESCRIPTION OF THE PREFERRED EMBODIMENTS

Figure 1:
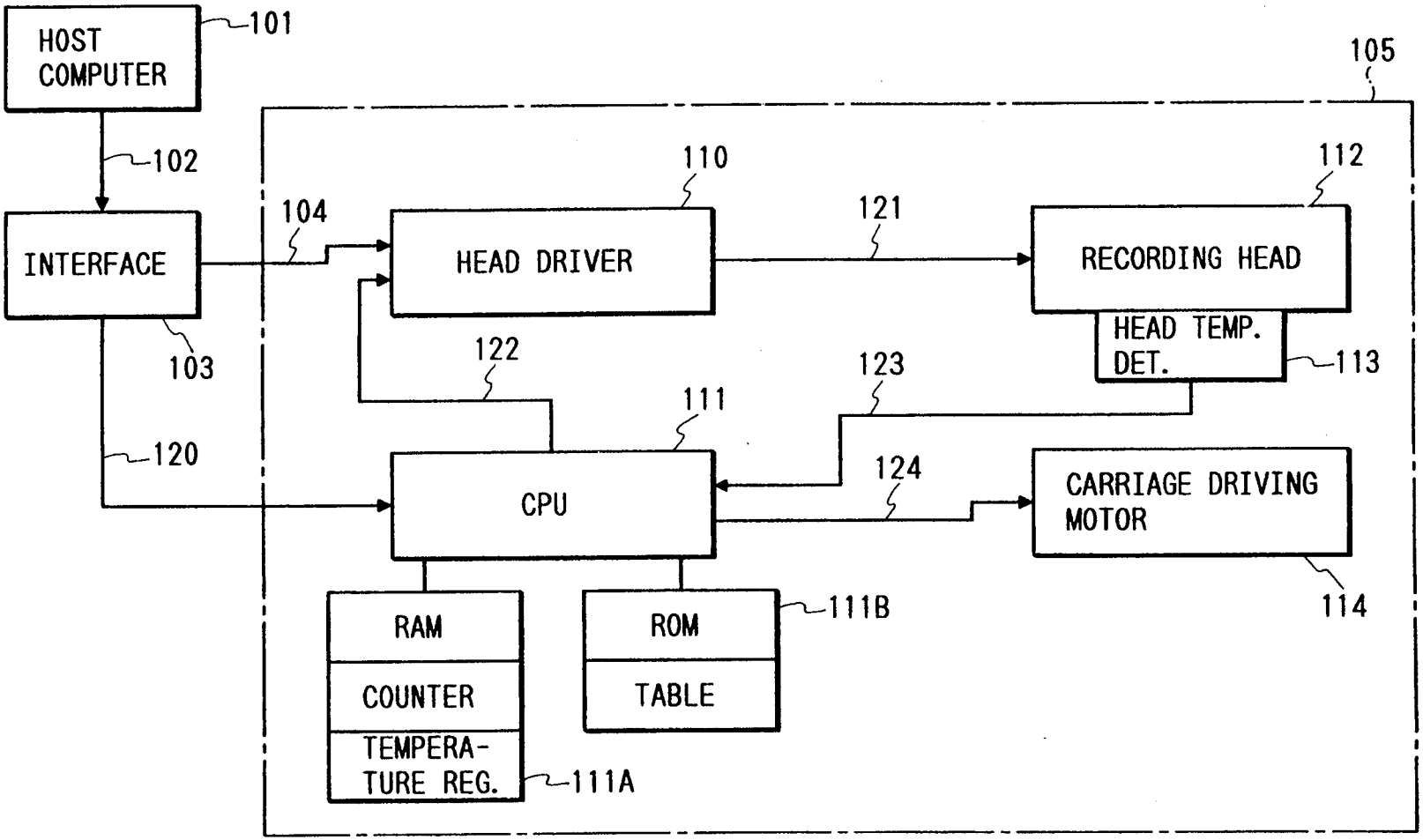
FIG. 1 is a block diagram showing the control constitution of an ink jet recording apparatus according to a first embodiment of the present invention.

The present invention will hereinafter be described in detail with respect to embodiments thereof shown in the drawings.

FIG. 1 is a block diagram for a system consisting of a recording apparatus according to the first embodiment of the present invention and its host computer.

Figure 7:
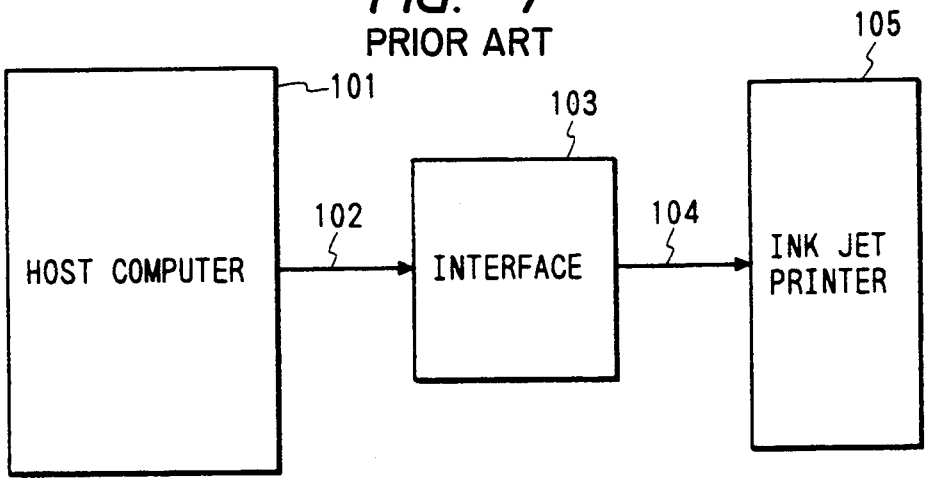
FIG. 7 PRIOR ART
FIG. 7 is a block diagram showing the constitution of computers using an ink jet recording apparatus as image information recording means.

In FIG. 1, numerals 101 and 103 are the same host computer and interface as described in FIG. 7 respectively. Numeral 105 is an ink jet printer, and the constitution thereof in this embodiment is described below.

A driver 110 drives a recording head 112 on the basis of driving data (image signal) 104 to be transferred from an interface 103. A CPU 111 controls each portion of a printer 105. A RAM 111A has an area to be used as a work area, etc. for control process by CPU 111, a counter area for counting a stand-by time as mentioned later, and a register for storing detected temperature. A ROM 111B has stored a procedure as mentioned later in FIG. 5, a table as mentioned later in FIG. 4, etc.

Numeral 112 is an ink jet type recording head for discharging ink by heat energy, and numeral 113 is head temperature detecting means such as a thermistor. A carriage driving motor 114 drives a carriage which carries a recording head 112 and scans for recording, and also performs a predetermined drive during dry ejection at a predetermined position as mentioned later. Numeral 102 is an image data signal, numeral 104 is a driving data signal, numeral 120 is a state indication signal from the interface, numeral 121 is a head driving signal, numeral 122 is a discharge indication signal, numeral 123 is a head temperature signal and numeral 124 is a carriage movement signal.

Figure 2A:
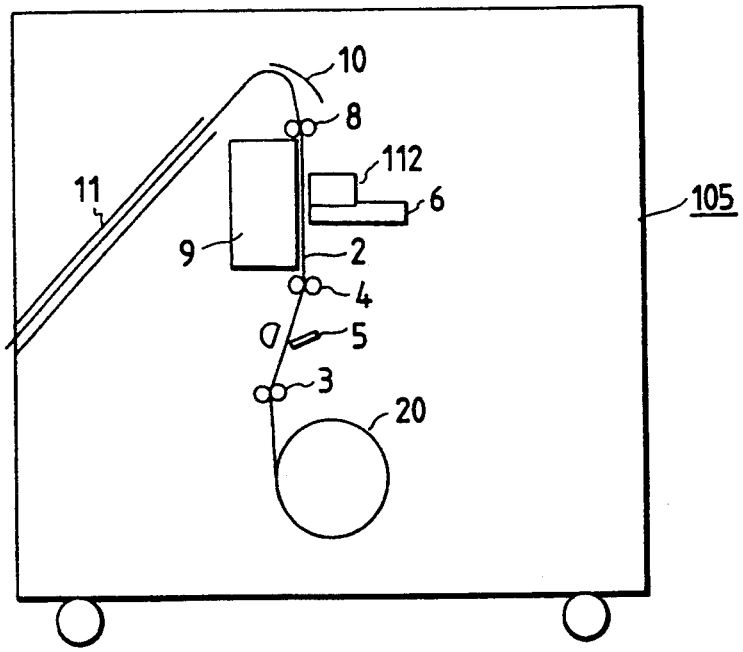
FIG. 2A PRIOR ART
FIGS. 2A and 2B are respectively a schematic sectional view and a schematic perspective view, showing conventional aspects of an ink jet recording apparatus useful in an embodiment of the present invention.
Figure 2B:
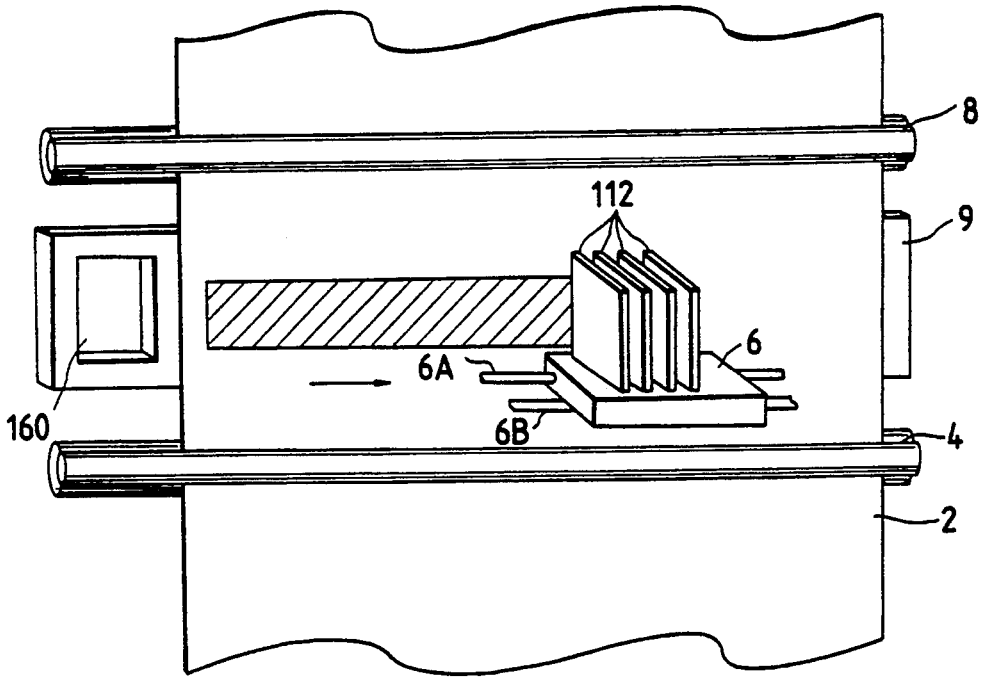
FIG. 2B PRIOR ART

FIGS. 2A and 2B are respectively a schematic sectional view and a principal portion perspective view of conventional aspects of the above-mentioned ink jet printer respectively.

In FIG. 2A, numeral 105 is a printer, numeral 2 is roll paper, numerals 3 and 4 are paper feed rollers, numeral 5 is a cutter, numeral 6 is a carriage, numeral 112 is an ink jet head, numeral 8 is a subscan roller, numeral 9 is a platen, and numerals 10 and 11 are paper guides.

In FIGS. 2A and 2B, a recording head 112 is carried on a carriage 6 to scan for recording, and is capable of moving to a predetermined position for dry ejection as mentioned later. The carriage 6 moves driven by the carriage motor (not shown) through a belt 6B while being guided along the moving path by a guide 6A in these movements. The recording head 112 consists of four recording heads corresponding to each ink of yellow, magenta, cyan and black as shown in FIG. 2B, and each recording head has, for example, 64 discharging orifices in the subscan direction (a direction perpendicular to the scanning direction).

An ink receiver 160 is provided in an area adjacent to the recording area for the recording head 112 so that it may be opposite to each discharging orifice thereof. A portion, which receives ink discharged from the recording head 112, is made of, for example, an ink absorber, and further the ink received together therewith can be designed to be led into a waste ink tank (not shown). The recording head 112 performs so-called dry ejection at a position opposite to the ink receiver 112 after standby for recording as mentioned later to heat the ink in each liquid channel. During the dry ejection, a capping member, etc. relating to discharge recovery can be used instead of using the exclusive ink receiver 160 as mentioned above.

In a range, which may be opposite to the discharging orifice forming surface of the recording head 112, a platen 9 extends to control the recording surface on recording sheet 2. The recording sheet 2 is cut into a single sheet state after a predetermined amount thereof is carried, but is housed in the form of roll paper 20 at a predetermined position of the printer 105 before it is recorded. One end of the roll paper 20 is fed to the recording area by a paper feed roller 3 in accordance to the recording operation, and is carried in the recording area while its recording surface is being controlled by a pair each of upstream side carrying roller 4 and downstream side carrying roller 8.

By successively repeating this carrying and scanning by a carriage 6, the recording head 112 discharges ink to record on the recording sheet 2. When a portion corresponding to the rear end of the first page of the recording paper 2 is carried to the position of a cutter 5, the recording paper 2 is cut by rotating this cutter. When recording for one page in this recording paper is finished thereafter, it is exhausted at a predetermined position of an exhaust paper tray, etc. through paper guides 10 and 11.

The recording head used in the above embodiment is an ink type recording head taking advantage of heat energy as mentioned above. A portion corresponding to one of the discharging orifices of this recording head is shown in FIGS. 3A and 3B.

Figure 3A:
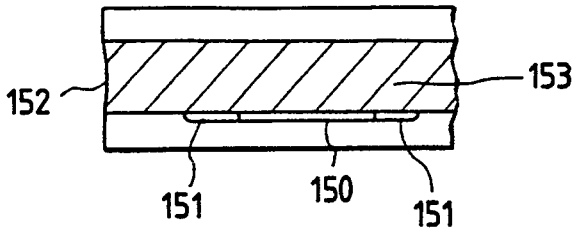
FIG. 3A PRIOR ART
FIGS. 3A and 3B are respectively a sectional view and a sectional perspective view showing conventional aspects of the ink liquid channel in a typical ink jet recording head useful in an embodiment of the present invention.

FIG. 3A is a sectional view of the discharging orifice and liquid channel in communication therewith. A heater (electricity-heat converter) 150 consists of a heating resistors, and an electrode 151 supplies power to the heater 150. The heater 150 and electrode 151 are formed on a substrate made of Si, etc. Numeral 152 is a discharging orifice, and numeral 153 is ink filled in the liquid channel.

Figure 3B:
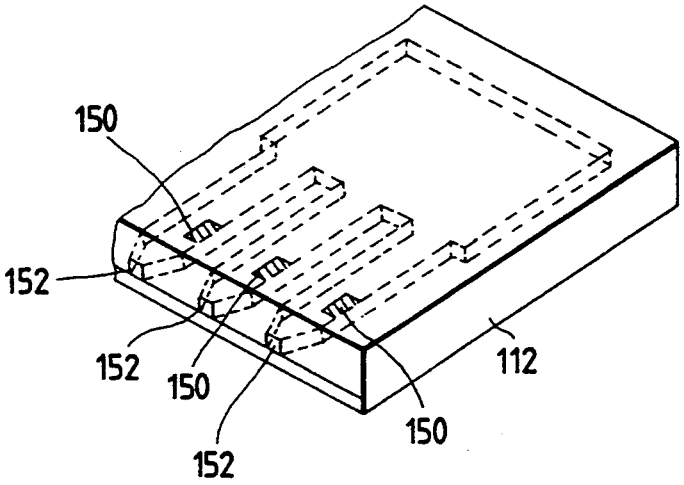
FIG. 3B PRIOR ART

FIG. 3B is a constitution diagram showing the above recording head.

In the recording head 112, a heater (electricity heat converter) 150, which generates heat energy for supplying an applied voltage, is disposed in each liquid channel to allow a plurality of discharging orifices 152 provided in rows to discharge the recording liquid. By applying a driving signal, the heater 150 is allowed to generate heat energy, causing film boiling of the ink to form a bubble in the ink liquid channel. The growth of this bubble discharges an ink droplet through the discharging orifice 152.

When discharging using such a head, the ink temperature in the liquid channel, where the heat of the heater 150 is directly applied to the ink to be discharged, rises comparatively fast. Since dry ejection is performed beforehand to prevent occurrence of a difference in recording density after such a recording stand-by as mentioned above, it is possible to reduce a difference between the ink temperature in the liquid channel and the temperature before the stand-by state as far as possible.

Figure 4:
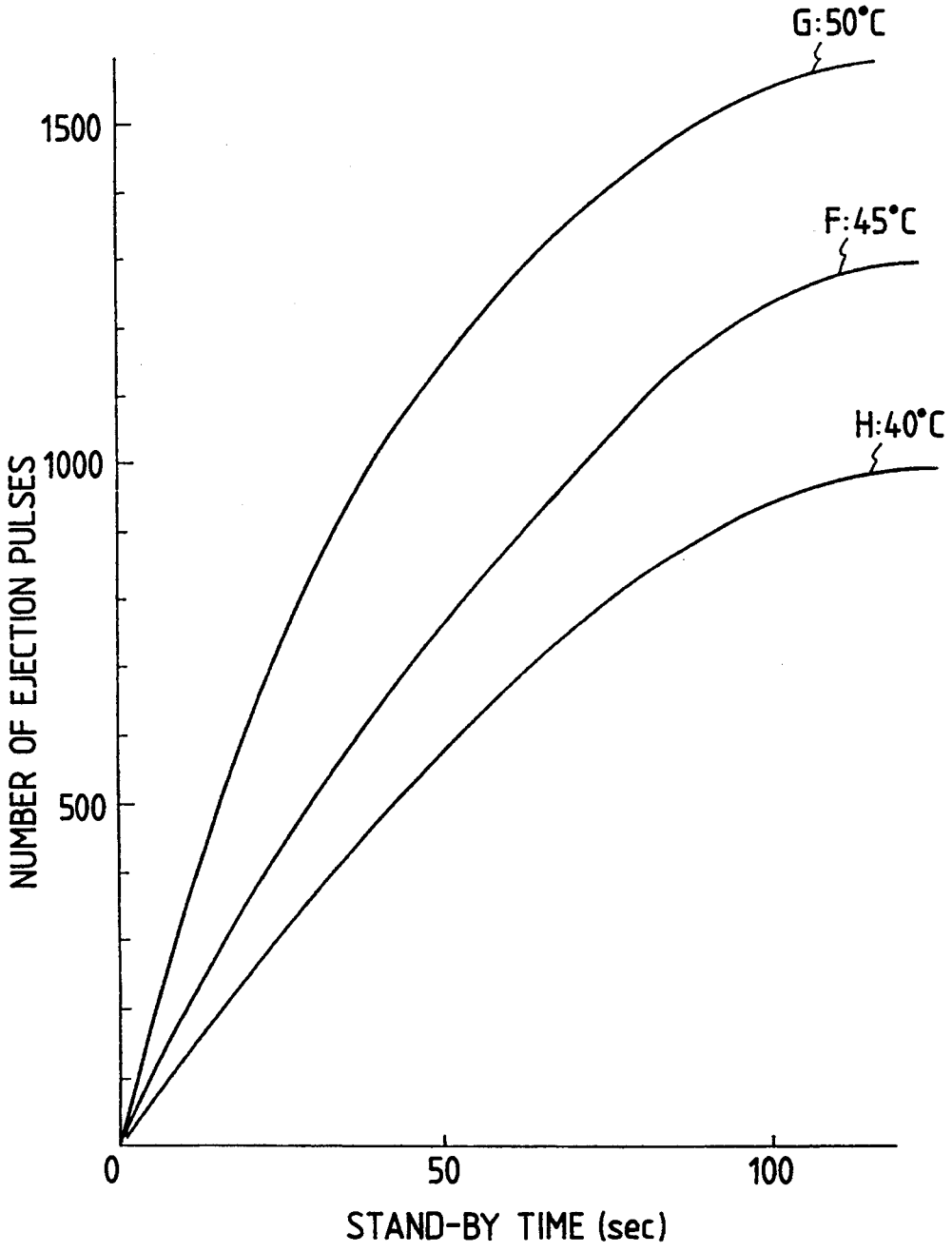
FIG. 4 is a graph showing the content of a table according to an embodiment of the present invention, a relationship between stand-by time and number of ejection pulses for each head temperature before the recording is interrupted.

FIG. 4 is a diagram showing a number of pulses for dry ejection to be output in accordance with the temperature before stand-by and the stand-by time. A curve F shows when the recording head temperature is 45° C. immediately before a stand-by state, a curve G for 50° C., and a curve H for 40° C. respectively. When the temperature immediately before the stand-by is higher, and the stand-by time is longer, the ink temperature in the liquid channel can be immediately brought close to the temperature before the stand-by state by performing dry ejection with more pulses, and it becomes possible to suppress the change in density as far as possible. Since the diagram shown in FIG. 4 differs with the construction of the head, it is desirable to obtain it by experiment beforehand.

Figure 5:
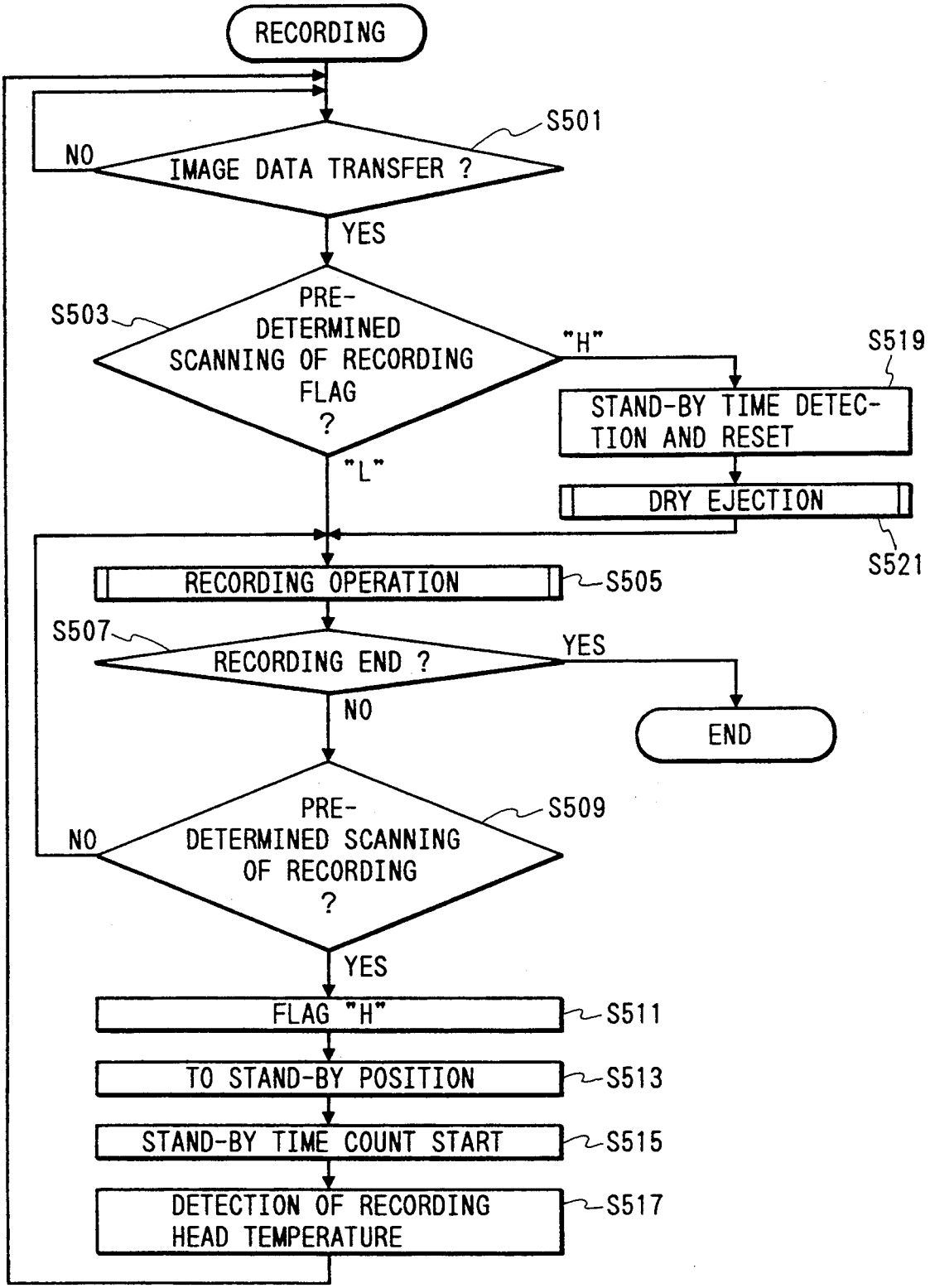
FIG. 5 is a flow chart showing the recording procedure according to the first embodiment of the present invention.

FIG. 5 is a flow chart showing the procedure of recording according to this embodiment. The recording process of this embodiment will be described referring to FIG. 5.

Figure 8:
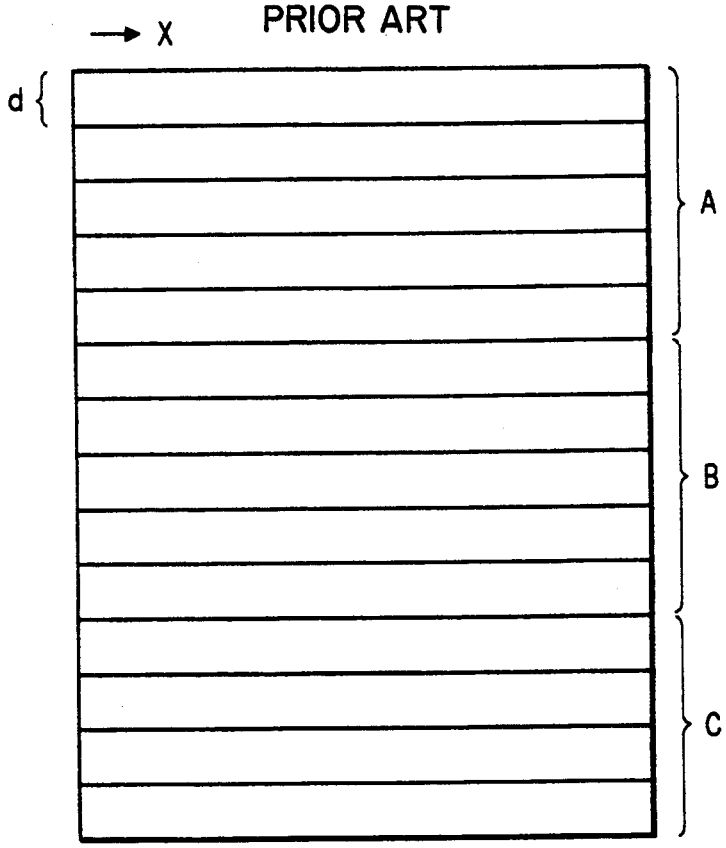
FIG. 8 PRIOR ART
FIG. 8 is a diagram for a typical sheet for assistance in explaining the mode of recording in the above constitution.
Figure 9:
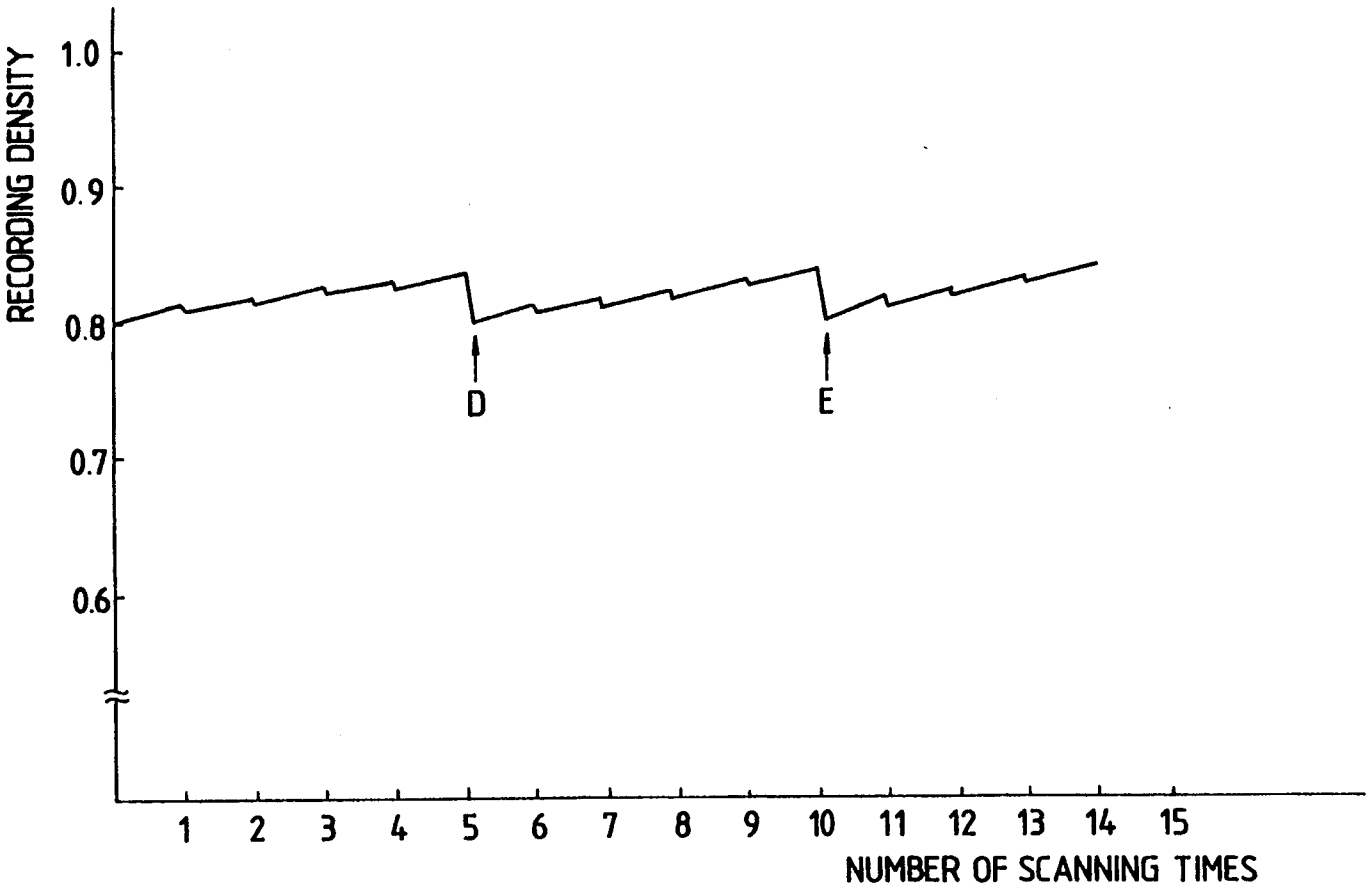
FIG. 9 PRIOR ART
FIG. 9 is a graph showing that a great difference in density occurs between before and after interruption of recording in a conventional recording apparatus.

When the recording process is started, stand by in step S501 while a predetermined amount of image data adapted to the memory capacity of the interface 103, for example, image data for five scans as described in FIG. 8 is transferred from the host computer 101 to the interface 103.

The transferred image data is stored in the memory of the interface 103, and is converted into driving data. When transfer of this predetermined amount is finished, it is judged through a flag in step S503 whether or not the above predetermined amount has been recorded after this procedure was started. That is, it is judged here whether or not it is the first recording out of recording for one page shown in FIG. 8. If the flag is "L", it is regarded as the first recording on the first page to proceed to step S505 for recording for one scan.

That is, while allowing the recording head 112 to be opposite to the recording area of recording sheet 2, the recording head 112 is once reciprocated within this range to perform recording for one scan by discharging ink in accordance with the going action or the reciprocation during this duration.

Then it is judged in step S507 from, for example, the content of a counter for number of scanning times stored in the CPU 111 whether or not recording for one page has been finished. If it is judged that the recording is not finished, it is judged in step S509 whether or not recording of a predetermined amount stored in the memory within the interface 103 is finished through driving data.

For example, in an embodiment shown in FIG. 8, it can be judged from the content of the counter stored in the CPU 111 whether or not recording for five scans is finished. If negatively judged here, the process in step S505 and after is repeated.

If it is judged in step S509 that recording for the driving data stored in the memory of the interface 103 is finished, a flag showing that scanning of the above predetermined amount has been finished is regarded as flag "H" in step S511, the recording head 112 is moved to the stand-by position such as a home position in step S513, and at the same time, counting of the stand-by time is started in step S515.

This counting can be performed by counting the period of a signal showing the stand-by state to be fed from the interface 103. Together with this process, the recording head temperature when scanning of the above predetermined amount is finished is detected in step S517, and after it is stored in the RAM 111A, the step returns to step S501 to enter a stand-by state.

In step S501, it is judged that transfer of the image data to the interface 103 has been finished. When it is further judged in step S503 that the content of the flag, which has been set in step S511, is "H", that is, when it is judged that the recording has been interrupted into a stand-by state, the step proceeds to step S519. The stand-by time, which has been counted so far, is detected and this counting time is reset. Then in step S521, the recording head 112 is moved to the position of the ink receiver 160 for dry ejection.

To perform this dry ejection, a number of ejections for dry ejection is determined by referring to the table, stored in the ROM 111B, having such a relationship as shown in FIG. 4, and on the basis of the stand-by time detected in step S519 and the recording head temperature before the stand-by, detected in step S517. After the completion of the dry ejection, the process proceeds to step S505 to start recording operation again.

In the above first embodiment, ink has been actually discharged to raise the temperature of the ink within the liquid channel after the stand-by. In the second embodiment, however, a driving pulse with a voltage, current or pulse width to such a degree that no ink is discharged is applied.

In the case of an ink jet type using heat energy, the heater may be damaged due to cavitation, etc. attendant upon formation and disappearance of a bubble during ink ejection. For this reason, an attempt is made to prevent the shortened life of the recording head as far as possible by trying to avoid unnecessary ink ejection as much as possible. Also the first embodiment requires means to collect ink discharged at the dry ejection position, possibly leading to a more bulky apparatus constitution.

In the above embodiment, the ink temperature within the liquid channel is allowed to rise fast by applying a driving pulse to such a degree that no ink ejection is performed to the heater within each liquid channel in order to suppress the change in density before and after the stand-by.

In addition, in the above first and second embodiments, the applied pulse of the discharge heater has been determined in accordance with the stand-by time and the head temperature before the stand-by. In the third embodiment, however, the applied pulse is determined taking the environmental temperature into consideration in addition to these two.

Figure 6:
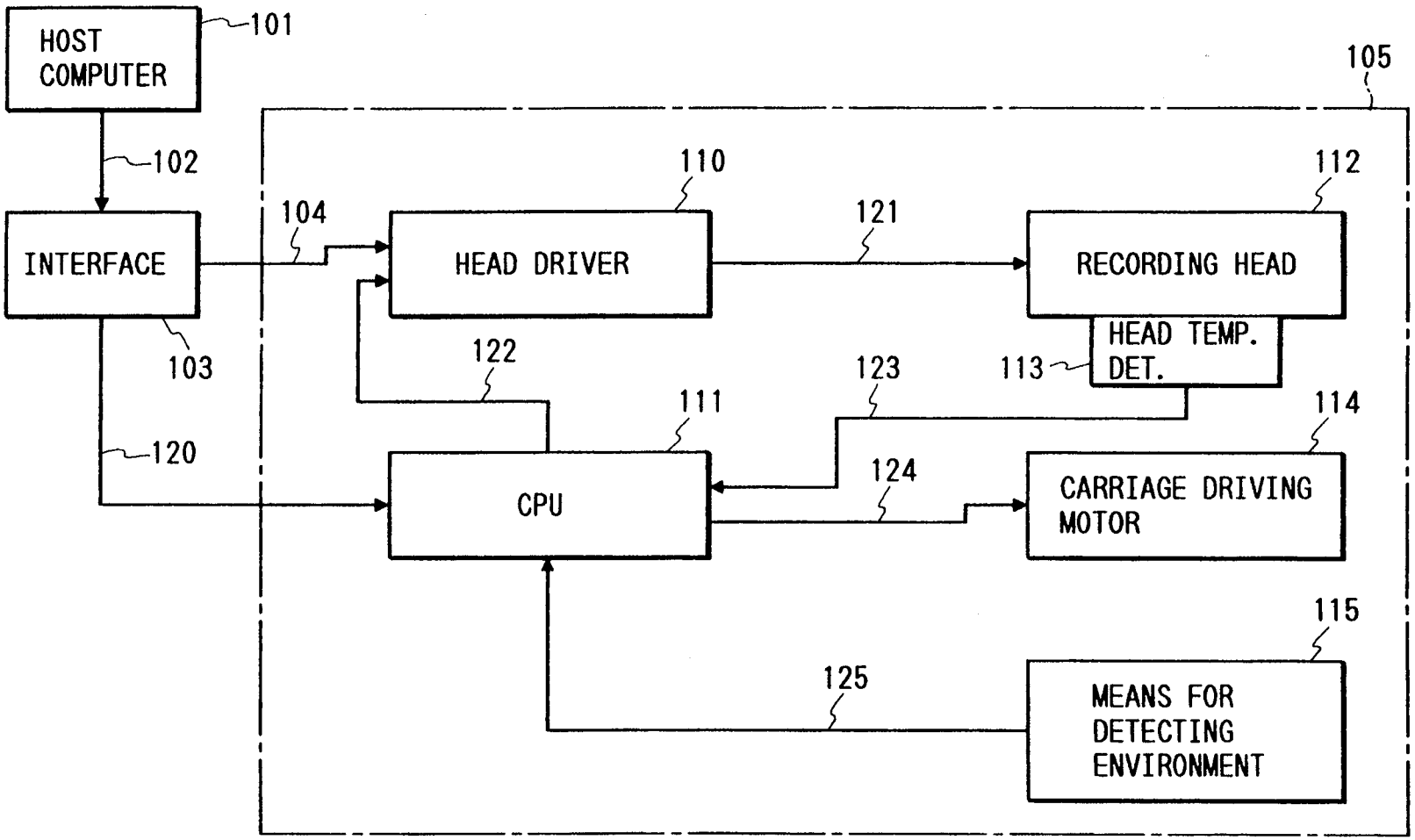
FIG. 6 is a block diagram showing the control constitution of an ink jet recording apparatus according to a third embodiment of the present invention.

In the third embodiment, environmental temperature detecting means 115 is separately provided as shown in FIG. 6 to input the environmental temperature into the CPU 111, and at the same time, to prepare a table having such a relationship as shown in FIG. 4 beforehand for each environmental temperature to be detected. When the environmental temperature is low, it is thereby possible to use more discharge pulses because the lowered head temperature during stand-by is great, and when the environmental temperature is high, it is possible to use less discharge pulses. As a result, it becomes possible to suppress the change in density more precisely.

For the driving pulse applied to head, not only its number of pulses but also the voltage and pulse width of the driving pulse may be made variable in accordance with the stand-by time.

As can be seen from the above description, according to the present invention, a recording head driving signal to control the temperature when resuming recording is determined in accordance with the recording head temperature when the recording is interrupted and the interruption time. Since the recording head is driven through this signal beforehand, the higher the temperature during interruption, and the longer the interruption time in, for example, the ink jet type recording head, it is possible to immediately return the recording head temperature to the temperature during interruption through a driving signal with more ejection pulses or a larger pulse width.

As a result, it is possible to suppress the difference in density of image, etc. to be recorded before and after the recording stand-by as far as possible, and to prevent the image quality from lowering due to the recording stand-by.

The fourth embodiment of the present invention will be described referring to the drawings.

Figure 10:
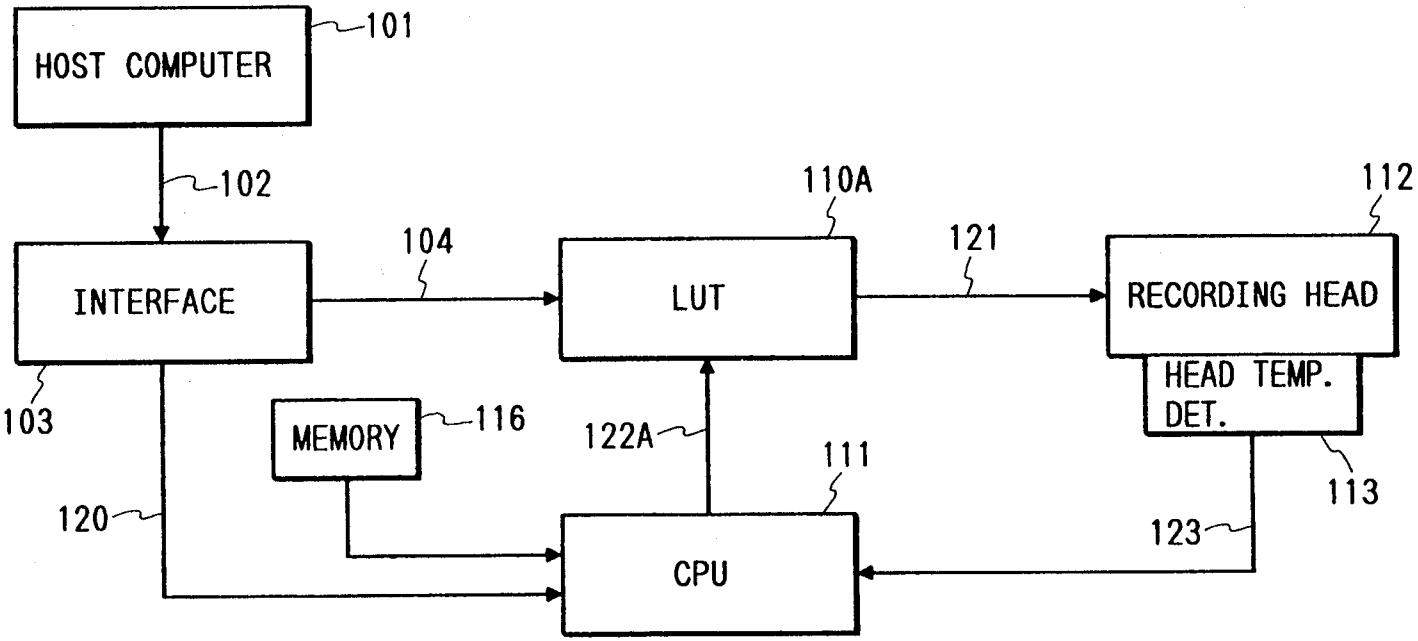
FIG. 10 is a block diagram showing a fourth embodiment of the present invention.
Figure 11:
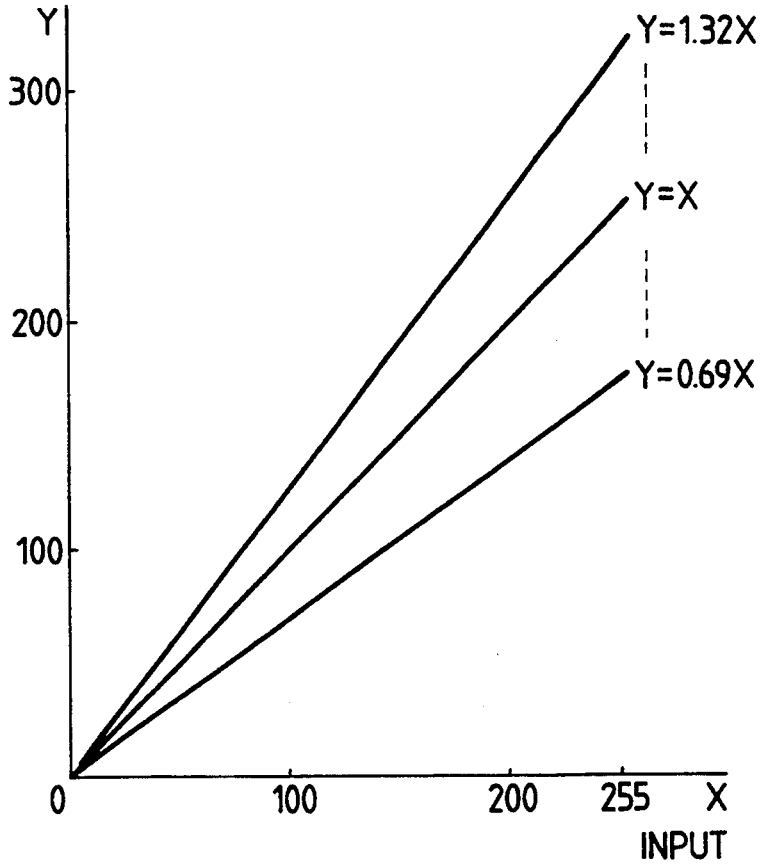
FIG. 11 is a graph showing a table stored in a look-up table 110A according to an embodiment in FIG. 10.
Figure 12:
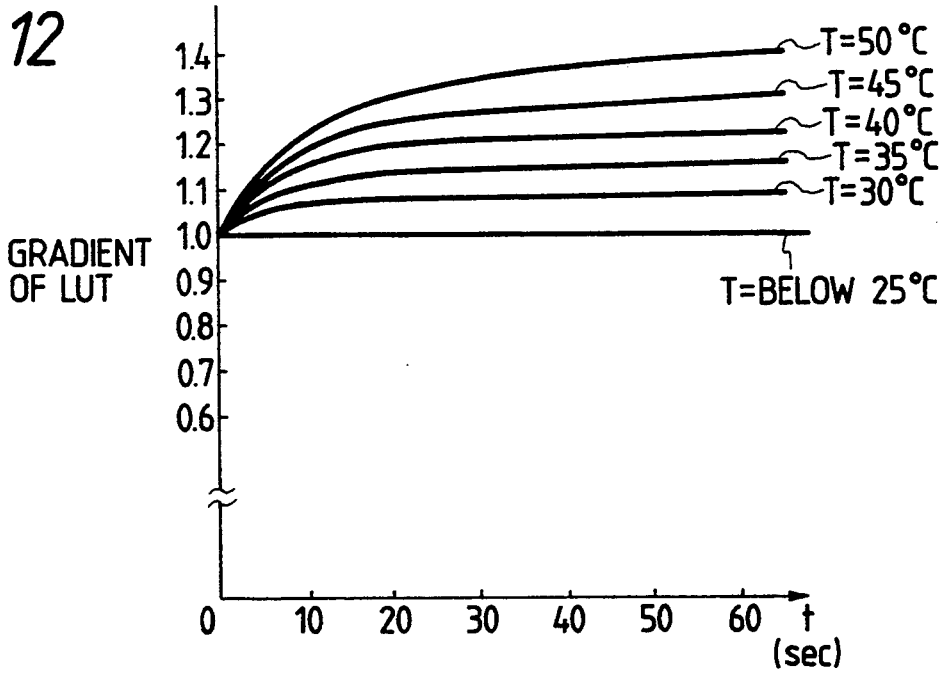
FIG. 12 is a graph showing data stored in a memory 116 according to an embodiment in FIG. 10.

FIG. 10 is a block diagram showing the fourth embodiment of the present invention, and portions with the same function as in FIG. 1 are affixed with the same symbols. FIG. 11 is a graph showing a table stored in the look-up table 110A in the embodiment in FIG. 10. FIG. 12 is a graph showing the data stored in the memory 116 in the embodiment in FIG. 10.

In FIG. 10, numeral 110A is a look-up table (LUT), numeral 116 is a memory, numeral 121 is an output image signal from the look-up table 110A, and numeral **122*a* is a look-up table selection signal of discharge command signals 122**.

An 8-bit image signal transferred from the host computer 101 is once stored in the memory within the interface 103, and then is input into a look-up table 110A (hereinafter called "LUT 110A") after being rearranged. In the LUT 110A, straight lines 0.01 each different in gradient from $Y=0.69X$ to $Y=1.32X$ are prepared as 64 tables as shown in FIG. 11, and the input signal is converted in accordance with a table selected through a selection signal 122A.

An output signal 121 from the LUT 110A is input into the recording head 112. The recording head 112 has a head driving circuit (not shown), which drives the recording head 112 through a driving pulse adapted to the input image data to discharge ink. The amount of discharged ink is ensured to be almost in proportion to the magnitude of the driving pulse.

When usual printing is started, a state indication signal 120 showing the usual printing state is transmitted to the CPU 111 from the interface 103. At this time, the CPU 111 selects one with a gradient of 1.0 from the LUT 110.

When recording of image for the memory capacity of the interface 103 is finished, the interface 103 transmits a signal showing a stand-by state to the CPU 111. On receipt of this signal, the CPU 111 detects a temperature T of the recording head 112 to once store it in a memory (not shown), and counts a time t until it receives a signal showing the usual printing state. When transfer of the data is finished to enter the next printing state, the CPU 111 determines a table to be selected from the LUT 110A in accordance with the head temperature T immediately before the interruption and the interruption time t when resuming the recording.

FIG. 12 is a graph showing conditions for deciding the graph gradient on the basis of the table of the LUT 110A, stored in the memory 116, to be selected when resuming printing.

When the head temperature immediately before the interruption is 25° C. or less, the head has the same temperature as the room temperature, and it is judged that there is no lowered temperature due to the interruption. Therefore, the graph gradient according to the table of LUT 110A remains at 1.0.

If, however, the head temperature immediately before the interruption is 25° C. or more, judging that the head temperature will lower due to the interruption, the same image density as that immediately before the interruption is ensured to be obtained by making the graph gradient, larger than 1.0, according to the table of LUT 110A on resuming. The longer the interruption time, and the higher the head temperature immediately before the interruption, the change in density during the interruption is compensated by making the graph gradient according to the table of LUT 110A the larger.

After resuming printing, the coefficient is gradually returned to the original. When, for example, a table corresponding to a graph with a gradient of 1.10 is selected from the LUT 110A on resuming and the interface memory has a capacity for 10 scans, an image is recorded on the basis of the table of the LUT 110A corresponding to a graph with a gradient of 1.01 on the 10th scan by continuing to decrease the gradient at a rate of 0.01 each for every scanning. When resuming recording after the next stand-by, correction is performed with a table with a gradient of 1.0 as a reference in the same manner.

Even if the head temperature lowers during stand-by, an uniform image free from any change in density in the real picture can be obtained by thus correcting the image signal.

In a color image forming apparatus, the above control may be independently provided for each color recording head.

On decreasing a graph gradient according to the table after resuming the recording, not only a number of scanning but also the recording time, number of recording pulses, etc. may be counted to return the coefficient accordingly.

Figure 13:
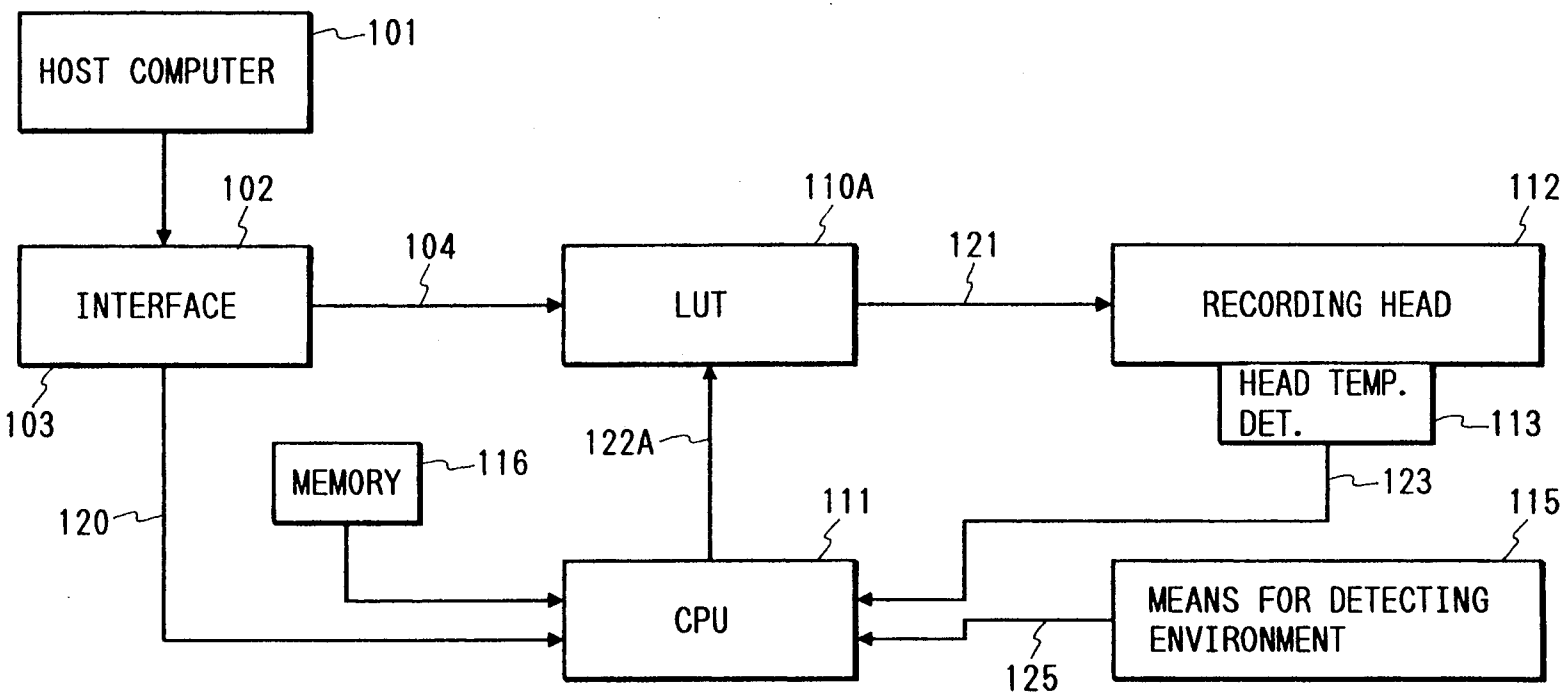
FIGS. 13 and 14 are block diagrams showing fifth and sixth embodiments of the present invention respectively.

FIG. 13 is a block diagram showing the fifth embodiment of the present invention.

In the above embodiment, environmental temperature detecting means 115 is added to the embodiment in FIG. 10, and a table determination condition of the LUT 110A has been prepared in the memory 116 for each environmental temperature.

The environmental temperature detecting means 115 is composed of a thermistor, etc., and detects the environmental temperature where the apparatus is placed to transmit an environmental temperature signal 125 to the CPU 111.

The CPU 111 selects a condition determination curve (not shown) in accordance with the environmental temperature, and further determines the graph gradient based on the table of LUT 110A in accordance with the head temperature before the interruption and the interruption time. The condition determination curve is stored in the ROM as the LUT 110A, and with each of the environmental temperature, the head temperature before interruption, and the interruption time as an address, the gradient is output.

For the condition determination curve to select the graph according to the LUT 110A, when the environmental temperature is low, a graph with more gradient should be selected because the head temperature drop is great during interruption, and when the environmental temperature is high, a graph with less gradient should be selected.

This enables suppressing the change in density more exactly.

Figure 14:
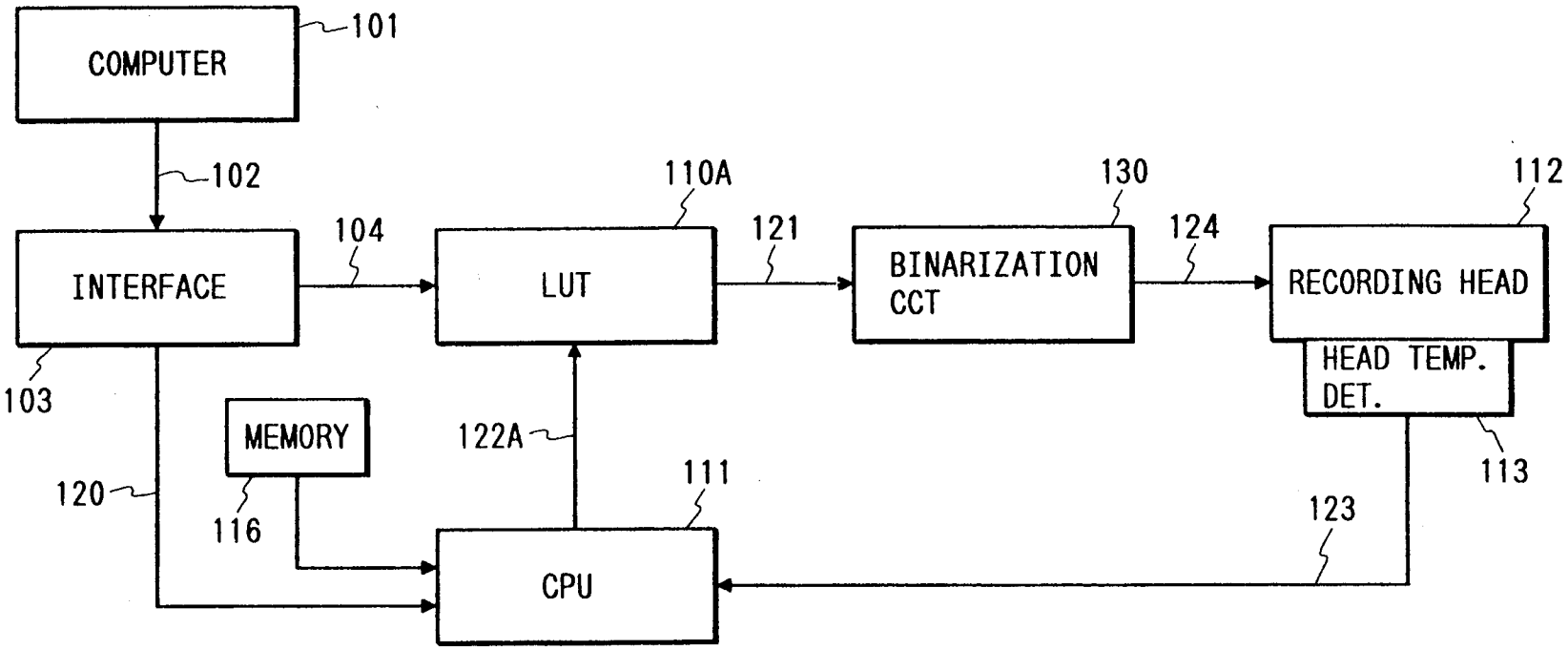

FIG. 14 is a block diagram showing the sixth embodiment of the present invention. Those affixed with the same number as those in FIG. 10 show the same component elements.

In the above embodiment, a binarization circuit 130 is inserted between the LUT 110A in the embodiment in FIG. 10 and the recording head 112 for connection.

In the embodiment in FIG. 10, a recording head, in which the size of the dot can be changed in accordance with the magnitude of an input image signal, is used. In the above embodiment, however, the present invention applies to a head in which the size of the dot cannot be changed or is difficult to be changed.

A binarization circuit 130 converts a multi-value image signal into a binary signal through the binarization method such as the dither method and the error diffusion method. The recording head prints dots with a predetermined size in accordance with a binary signal for image recording. Other functions are the same as in the embodiment in FIG. 10.

In such a constitution, it is possible to compensate the lowered density by printing more dots per unit area in order to obtain an uniform image free from any change in density in the actual picture when resuming recording even if the temperature lowers during stand-by.

As mentioned above, the present invention has such an effect that the change in image density due to interruption is compensated and an uniform image free from any change in density can be obtained by correcting the image signal to be applied to the image recording head on the basis of the image recording head temperature when the recording is interrupted and the time until recording is resumed since interrupted on resuming the recording.

The seventh embodiment will be described referring to the drawings.

Figure 15:
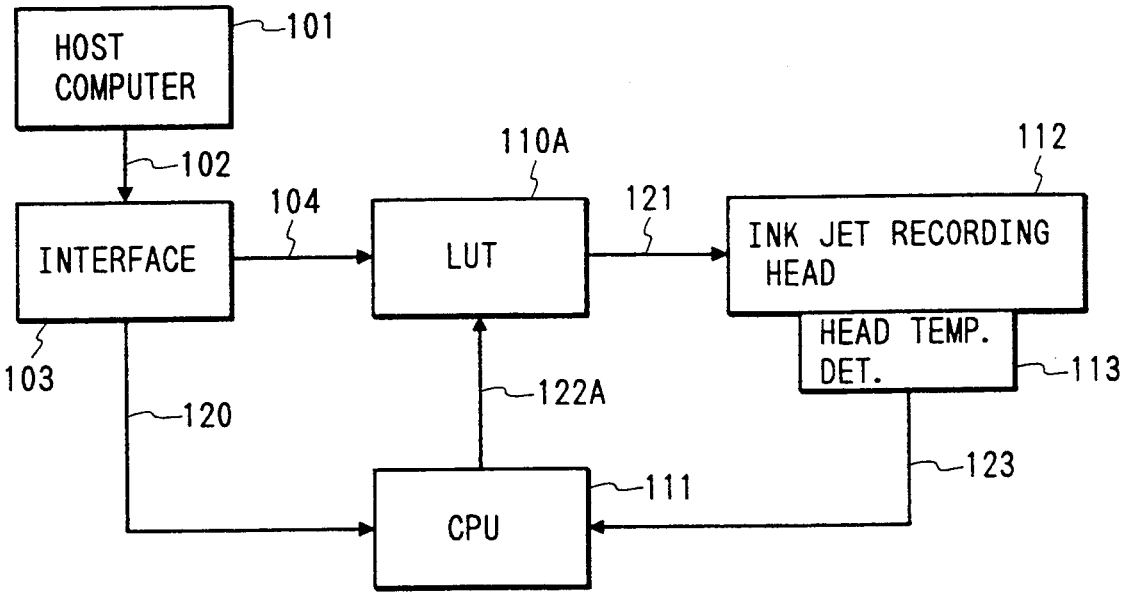
FIG. 15 is a block diagram showing a seventh embodiment of the present invention.

FIG. 15 is a block diagram showing a constitution of the seventh embodiment of the present invention, and portions having the same function as in FIG. 10 are affixed with the same symbols.

In FIG. 15, numeral 112 is an ink jet recording head with a constitution shown in FIG. 3, numeral 113 is head temperature detecting means such as a thermistor, numeral 123 is a head temperature signal, and controlling means is composed of a CPU 111 and an LUT 110A. The ink jet recording head 112 consists of a plurality of recording heads, and recording liquids with different colors are discharged from the respective recording heads.

An 8-bit image signal 102 transferred from the host computer 101 is once stored in the memory within the interface 103, and then is input into LUT 110A after being rearranged.

In the LUT 110A, 64 sets of tables consisting of straight lines 0.01 each different in gradient from $Y=0.69X$ to $Y=1.32X$ are stored as shown in the above FIG. 11, and the magnitude of the pulse of the input image signal is converted in accordance with a table selected through an LUT selection signal 122A.

When usual printing is started, a state indication signal 120 to be output from the interface 103 shows an usual printing state. At this time, the CPU 111 outputs an LUT selection signal 122A showing that a table with a gradient of 1.0 is selected to the LUT 110A.

Then when recording of image for the memory capacity of the interface 103 is finished, the interface 103 transmits a signal showing a stand-by state to the CPU 111. On receipt of this signal, the CPU 111 detects a temperature $T_1$ of the ink jet recording head 112 through a head temperature signal 123 to be output by the head temperature detecting means 113 to once store it in a built-in memory (not shown). Then the CPU 111 stands by until the host computer 101 finishes transmitting the next image data to the interface 103.

Thereafter transmitting of the data is finished, and immediately before the next printing begins, the CPU 111 detects a temperature $T_2$ of the ink jet recording head 112 again to calculate $(T_1-T_2)$, that is, the temperature difference between before and after the recording interruption. Then the CPU 111 selects a table of the LUT 110A in accordance with the value of the difference in temperature $(T_1-T_2)$ when resuming recording.

Figure 16:
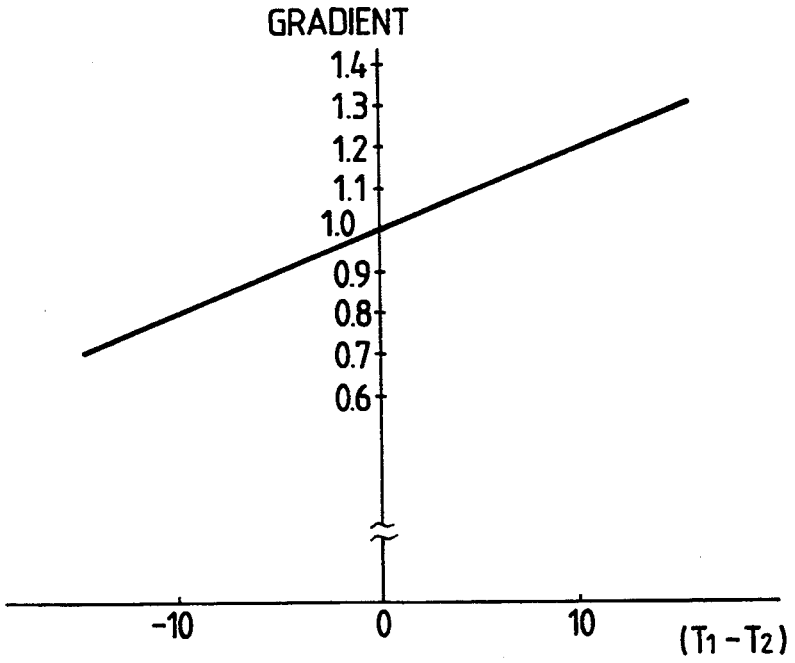
FIG. 16 is a graph of assistance in explaining conditions under which each table stored by a LUT 110A in FIG. 15 is selected.

FIG. 16 shows a relationship between the value of the difference in temperature $(T_1-T_2)$ and the gradient of a table of LUT 110A to be selected in accordance with this value. As shown therein, the larger $(T_1-T_2)$, a table with a larger coefficient is selected on resuming. This is because the lowered recording density is compensated by raising the image signal level even if the recording density lowers due to lowered temperature during stand-by. The above coefficient is gradually returned to the original after printing is resumed.

When, for example, a table with a gradient of 1.10 is selected on resuming and the memory of the interface 103 has a capacity for 10 scans, an image is recorded using a table with a gradient of 1.01 on the 10th scan by continuing to decrease the gradient at a rate of 0.01 each for every scanning. When resuming recording after the next stand-by, a table of LUT 110A is selected with a table with a gradient of 1.0 as a reference in the same manner for correction. Even if the head temperature lowers during stand-by, an uniform image free from any change in density in the real picture can be obtained because the image signal is to be corrected in accordance with this lowered temperature.

In a color image forming apparatus, the above control may be independently performed for each color recording head.

On returning the table gradient after resuming the recording, not only a number of scannings but also the recording time, number of recording pulses, etc. may be counted to return the coefficient to the original accordingly.

The eighth embodiment of the present invention will be described.

Figure 17:
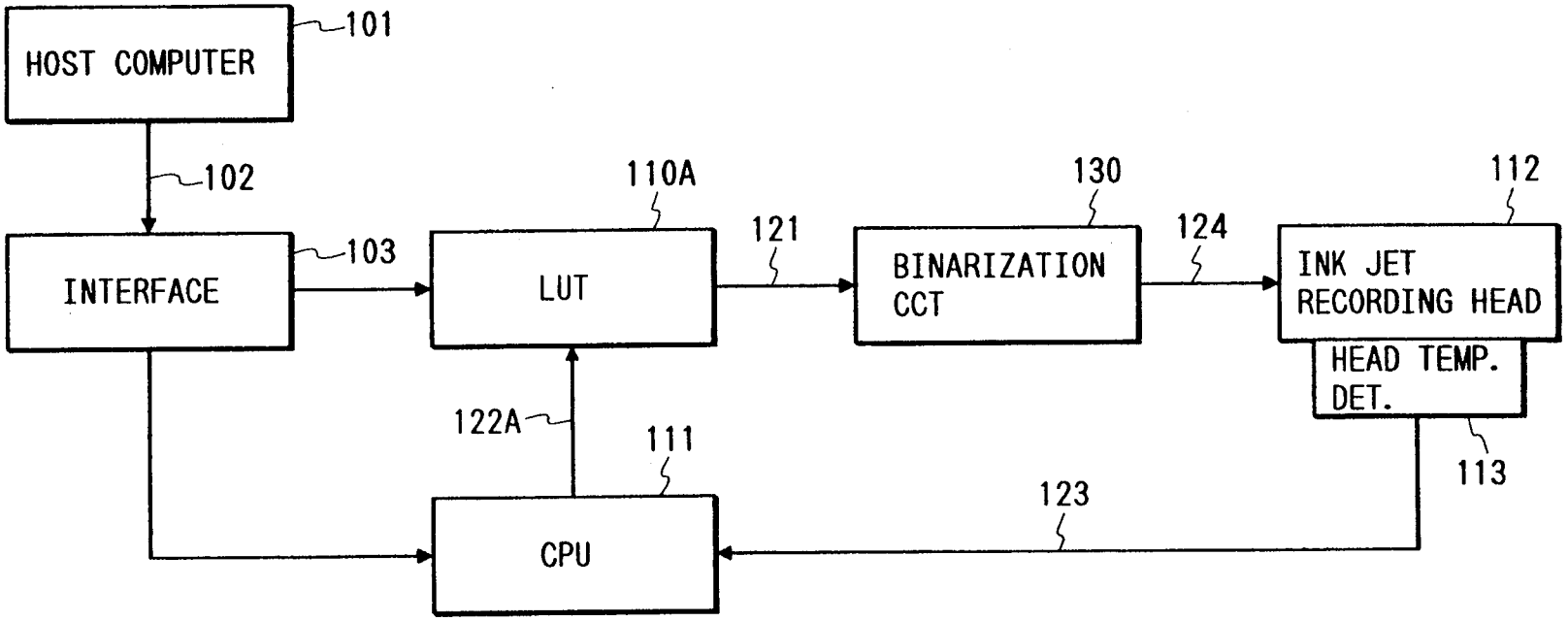
FIG. 17 is a block diagram showing an eighth embodiment of the present invention.

In the embodiment in FIG. 17, a recording head, in which the size of the dot can be changed according to the magnitude of an input image signal, is used. In the above embodiment, however, the present invention applies to a head in which the size of the dot cannot be changed or is difficult to be changed.

FIG. 17 is a block diagram showing the constitution of the above embodiment, and those affixed with the same numbers as in FIG. 15 have the same component elements.

In FIG. 17, a binarization circuit 130 converts an output image signal 121 to be transmitted from a LUT 110A into a binary signal by the binarization method such as the dither method and the error diffusion method. The ink jet recording head 112 prints dots with a predetermined size in accordance with a binary signal 124 to be transmitted by the binarization circuit 130 for image recording. Other functions are the same as in the seventh embodiment.

In such a constitution, it is possible to compensate the lowered density by printing more dots when resuming recording even if the temperature lowers during stand-by in order to obtain an uniform image free from any change in density in the actual picture.

The ninth embodiment will be described. In the abovementioned seventh and eighth embodiments, the table gradient is returned to the original a predetermined amount each for every scanning after recording is resumed. In this embodiment, however, while detecting the head temperature, the gradient is returned in accordance with the amount of detection.

For example, it is assumed that a difference in temperature between before and after stand-by is $\Delta T=(T_1-T_2)$, a table with a gradient of K is selected in accordance with the difference in temperature $\Delta T$, and the head temperature when recording on the n-th scan begins after recording is resumed is t. In this case, a table with a gradient of $1+(T_1-t)/(T_1-T_2)\times(K-1)$ is selected as a table in this scanning.

It is assumed that when a table with $K=1.2$ is selected at, for example, $\Delta T=10°$, the temperature has been considerably returned and is only 4° C. lower than $T_1$ when recording on the second line begins. In this case, the gradient of the second line is as follows:

$$1+4/10\times(1.2-1)=1.08$$

By doing as mentioned above, the gradient of the table to be used at a temperature closer to the actual ink jet recording head temperature can be brought near to the original value.

In the above embodiment, there are instances where the gradient immediately before the next interruption does not return to 1.0. In this case, assuming the gradient immediately before the next interruption to be K', a table with a gradient obtained by multiplying the gradient obtained from FIG. 16 by K' may be used as a table on the next resuming.

The present invention has such an effect that the recording density can be prevented from changing on resuming recording and an uniform image can be obtained on interrupting and resting recording because on resuming recording, the image signal is corrected in accordance with a difference between a recording head temperature at that time and a recording head temperature on interrupting recording. Also since the image signal after resuming recording is recorrected in accordance with the state of use or the temperature of the recording head, the image after resuming recording can be made uniform.

Figure 18:
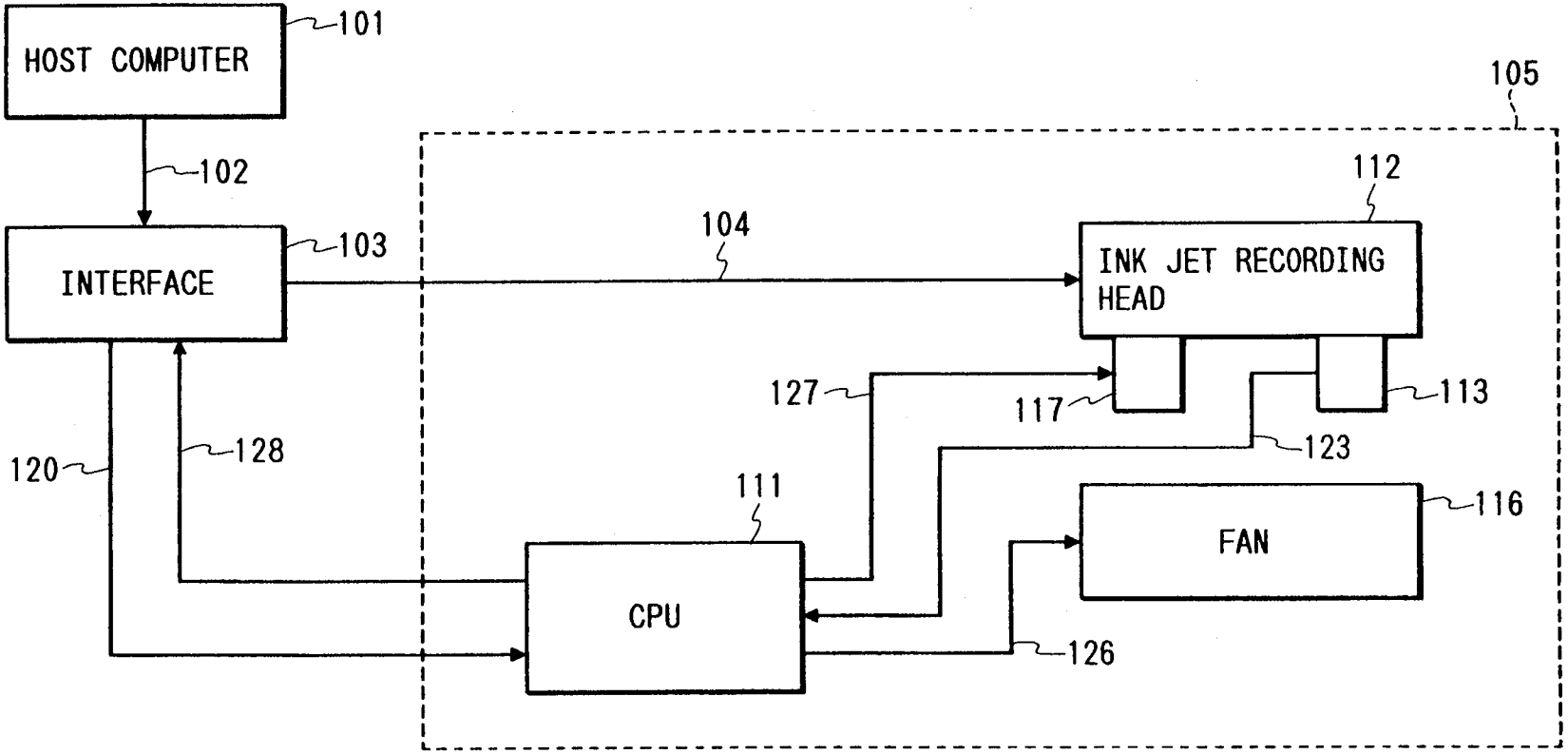
FIG. 18 is a block diagram showing a tenth embodiment when the present invention has been applied to output of computer graphic.

FIG. 18 is a block diagram showing the tenth embodiment when the present invention is applied to the output for computer graphics.

In FIG. 18, numeral 105 is an ink jet printer, numeral 112 is an ink jet recording head, numeral 101 is a host computer, numeral 102 is an image signal, numeral 103 is an interface, numeral 104 is an image signal, numeral 111 is a CPU (Central Processing Unit), numeral 113 is head temperature detecting means such as a thermistor, numeral 116 is a fan, numeral 117 is a head temperature controlling heater, numeral 120 is a state indication signal from the interface, numeral 123 is a head temperature signal, numeral 126 is a fan driving signal, numeral 127 is a head heater driving signal and numeral 128 is an inhibit signal.

The temperature controlling means is composed of the CPU 111, head temperature detecting means 113 and a head heater 117. The CPU 111 also constitutes memory means and resuming means.

Figure 19:
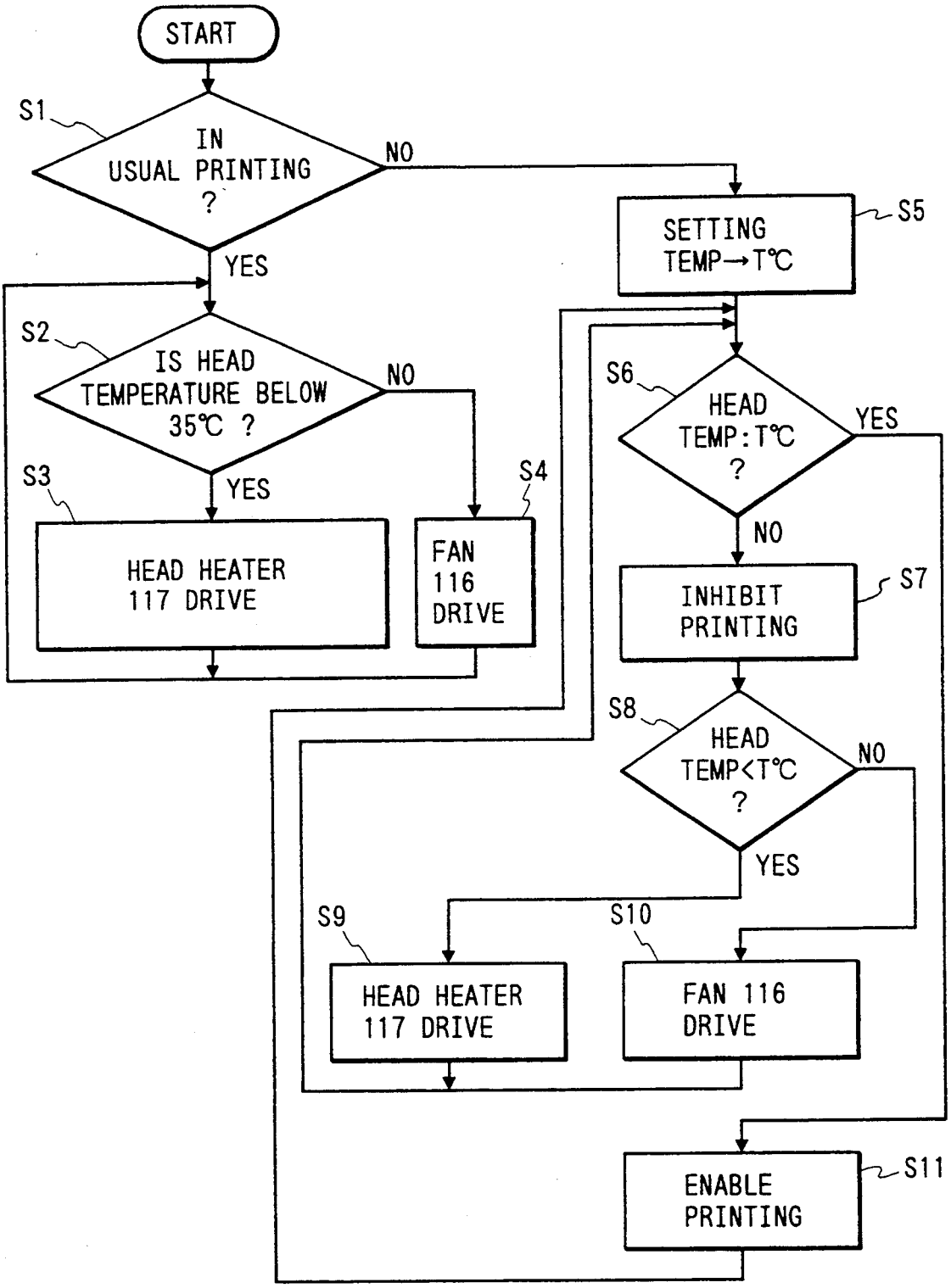
FIG. 19 is a flow chart showing the control of a tenth embodiment of the present invention.

The control in the tenth embodiment shown in FIG. 18 will be described referring to FIG. 19.

It is first checked whether or not it is in usual printing (step S1). If in usual printing, an image signal 102, which is an image data from the host computer 111, is once stored in a memory (not shown) within the interface 103. The interface 103 rearranges the stored image data so that it is received by an ink jet head 112 to transmit it to the ink jet head 112 as an image signal 104. The ink jet head 112 prints in accordance with the image signal 104.

During this period, the interface 103 transmits an interface state indication signal 120 showing an usual printing state to the CPU 111. While this interface state indication signal 120 is being transmitted, the CPU 111 sets a present temperature for controlling temperature to an usual value, for example, 35° C. A head temperature signal 123 from the head temperature detecting means 113 is input into the CPU 111, and if it is higher than 35° C., the CPU 111 outputs a fan driving signal 126 to drive a fan 116. If lower than 35° C., the CPU 111 outputs a head heater driving signal 127 to drive a head heater 117 to maintain the temperature (hereinafter called "head temperature") of the ink jet head 112 within a predetermined range (for example, 34° C. to 36° C.) (steps S2, S3, S4).

When recording of an image for the memory capacity of the interface 103 is finished, the interface 103 transmits an interface state indication signal 120 showing a stand-by state, in which recording is being interrupted, to the CPU 111. On receipt of this interface state indication signal 120, the CPU 111 once stores the head temperature (T° C.) at the time to set it to a preset temperature for controlling temperature (step S5).

Thereafter, the CPU 111 inputs a head temperature signal 123 from the head temperature detecting means 113 again to check the head temperature (step S6). If the head temperature is equal to the preset temperature (T° C.) left stored in the CPU 111, printing is enabled as soon as the stand-by state is finished (step S11). However, if the head temperature is not equal to the preset temperature (T° C.), the CPU 111 transmits an inhibit signal 128 to the interface 103 to inhibit the ink jet head 112 from transmitting an image signal 104 even if transfer of data from the host computer 101 to the interface 103 is finished (step S7).

If the head temperature is lower than the preset temperature (T° C.), a head heater 115 is driven, and if higher than the preset temperature, a fan 114 is driven to lower the head temperature so that it is equal to the preset temperature (T° C.) (steps S8, S9, S10). If the head temperature is equal to the preset temperature (T° C.), the state is returned to a printable state to resume recording of an image (step S11).

Since recording is resumed after the head temperature is returned to that immediately before recording interruption, even if recording is thus interrupted into a stand-by state and the head temperature changes, it is possible to obtain an uniform image free from any change in image density.

Figure 20:
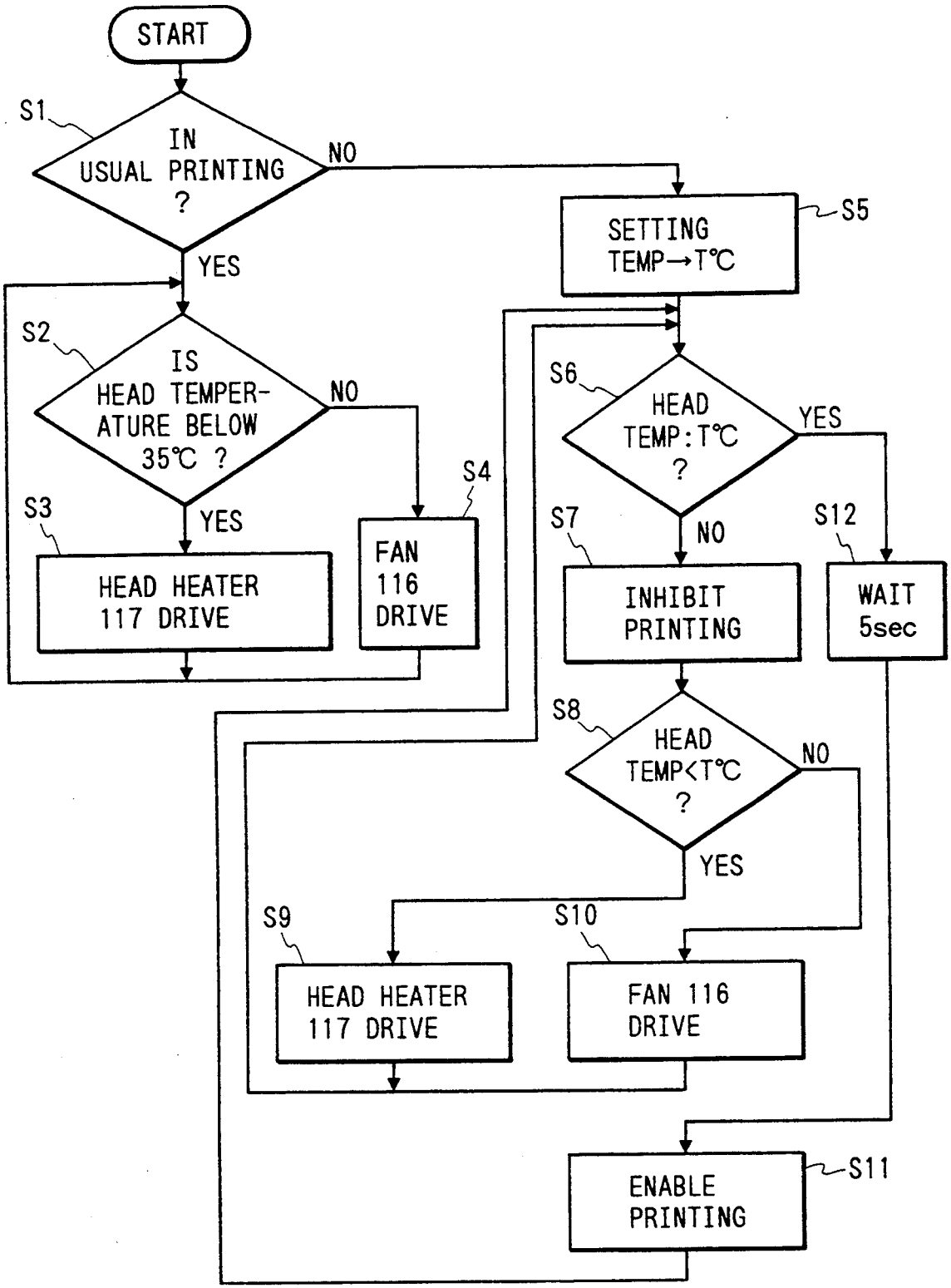
FIG. 20 is a flow chart showing the control of an eleventh embodiment of the present invention.

The eleventh embodiment will be described. FIG. 20 shows the control of the eleventh embodiment, and the eleventh embodiment is different from the tenth embodiment in that printing is not enabled immediately even if the head temperature reaches the preset temperature (T° C.), but it is enabled five seconds later on resuming recording from the stand-by state.

This is for the following reason:

A thermistor as head temperature detecting means, which detects the head temperature, is generally mounted to the substrate of the recording head. For example, in the case of an ink jet head, when the temperature of ink within the nozzle does not reach the predetermined temperature even if a temperature to be detected by this thermistor reaches the predetermined temperature, a difference in printing density still remains.

For this reason, by waiting five seconds after the thermistor detection temperature reaches the preset temperature (T° C.) (step S12) in the eleventh embodiment, it is ensured that the temperature of ink within the ink jet head nozzle reaches the preset temperature (T° C.). As a result, change in density can be securely suppressed. For other than the above step 12, the description is omitted because those are the same as in FIG. 19.

In the above-mentioned tenth and eleventh embodiments, when an ink jet head using heat energy composed of such head elements as shown in FIG. 3 is used for ejection, the temperature of ink within the nozzle rises abruptly, and therefore, it is possible to return the temperature of ink within the nozzle to a temperature immediately before recording interruption in a very short time.

The twelfth embodiment will be described. In this embodiment, the present invention applies to an ink jet printer shown in the above FIG. 2B. In the above embodiment, when recording of recording image for one line is finished, recording for one line is repeated again after subscanning roll paper 2 by a subscan roller 8.

This twelfth embodiment utilizes heat energy for ejection of the above-mentioned ink jet head using heat energy, and if the temperature of the ink jet head 112 is lower than the preset temperature (T° C.), ink is ejected at a dry ejection position 160 provided in a non-image area at the left end of the platen 9 in addition to driving of a head heater (not shown). By means of heat generated at this time, the temperature of the ink jet head 112 has been designed to reach the preset temperature (T° C.) earlier.

This enables the temperature of ink within the nozzle of the ink jet head 112 to immediately return to a temperature before the recording interruption, reducing some loss in time.

As mentioned above, the present invention is able to compensate any change in image density due to recording interruption and obtain an uniform image with less change in density by controlling the recording head temperature so that it is almost equal to a temperature when recording was interrupted on resuming after interrupting recording.

Although an ink jet recording apparatus using a serial type recording head has been described in the above embodiments, one using a full line type recording head may be used.

In addition, the present invention can be applied to not only an ink jet recording head using heat energy, etc., but also to others, such as thermal transfer, in which the temperature of the recording head rises during driving.

Further, the stand-by state is not always limited to time to receive transfer data. The present invention can apply even when a stand-by state occurs during printing for other objects including head recovery operation such as sucking of ink during printing and wiping of the ejection surface.

The present invention brings about excellent effects particularly in an ink jet system using heat energy among the ink jet recording system.

As to its representative constitution and principle, for example, one practiced by use of the basic principle disclosed in, for example, U.S. Pat. Nos. 4,723,129 and 4,740,796 is preferred. This system is applicable to either of the so called on-demand type and the continuous type. Particularly, the case of the on-demand type is effective because, by applying at least one driving signal which gives rapid temperature elevation exceeding nucleate boiling corresponding to the recording information on an electricity-heat converters arranged corresponding to the sheets or liquid channels holding liquid (ink), heat energy is generated at the electricity-heat converters to effect film boiling at the heat acting surface of the recording head, and consequently the bubbles within the liquid (ink) can be formed corresponding one by one to the driving signals.

By discharging the liquid (ink) through an opening for discharging by growth and shrinkage of the bubble, at least one droplet is formed. By making the driving signals into pulse shapes, growth and shrinkage of the bubble can be effected instantly and adequately to accomplish more preferably discharging of the liquid (ink) particularly excellent in response characteristic.

As the driving signals of such pulse shape, those as disclosed in U.S. Pat. Nos. 4,463,359 and 4,345,262 are suitable. Further excellent recording can be performed by employment of the conditions described in U.S. Pat. No. 4,313,124 of the invention concerning the temperature elevation rate of the above-mentioned heat acting surface.

As the constitution of the recording head, in addition to the combination constitutions of discharging orifice, liquid channel, electricity-heat converter (linear liquid channel or right angle liquid channel) as disclosed in the above-mentioned respective specifications, the constitution by use of U.S. Pat. No. 4,558,333, or 4,459,600 disclosing the constitution having the heat acting portion arranged in the flexed region is also included in the present invention. In addition, the present invention can be also effectively made the constitution as disclosed in Japanese Patent Laid-Open Application No. 59-123670 which discloses the constitution using a slit common to a plurality of electricity-heat converters as the discharging portion of the electricity-heat converter or Japanese Patent Laid-Open Application No. 59-138461 which discloses the constitution having the opening for absorbing pressure wave of heat energy corespondent to the discharging portion.

Further, as the recording head of the full line type having a length corresponding to the maximum width of recording medium which can be recorded by the recording device, either the constitution which satisfies its length by combination of a plurality of recording heads as disclosed in the above-mentioned specifications or the constitution as one recording head integrally formed may be used, and the present invention can exhibit the effects as described above further effectively.

In addition, the present invention is effective for a recording head of the freely exchangeable chip type which enables electrical connection to the main device or supply of ink from the main device by being mounted on the main device, or for the case by use of a recording head of the cartridge type provided integrally on the recording head itself.

Also, addition of a restoration means for the recording head, a preliminary auxiliary means, etc. provided as the constitution of the recording device of the present invention is preferable, because the effect of the present invention can be further stabilized. Specific examples of these may include, for the recording head, capping means, cleaning means, pressurization or aspiration means, electricity-heat converters or another heating element or preliminary heating means according to a combination of these, and it is also effective for performing stable recording to perform preliminary mode which performs discharging separate from recording.

Further, as the recording mode of the recording device, the present invention is extremely effective for not only the recording mode only of a primary color such as black etc., but also a device equipped with at least one of plural different colors or full color by color mixing, whether the recording head may be either integrally constituted or combined in plural number.

Further in addition to those used as an image output terminal for information processing equipment such as computers, as a form of an ink jet recording apparatus of the present invention, copying apparatus combined with a reader, etc., and those which assume the form of a facsimile equipment having transmitting and receiving functions may be used.

What is claimed is:

1. An image recording apparatus comprising:

a recording head for recording an image in a normal recording operation subject to interruption and subsequent resumption;

temperature controlling means for detecting the temperature of said recording head and controlling the temperature within a predetermined range;

memory means for storing a temperature of said recording head when a recording operation is interrupted; and resuming means for controlling said temperature controlling means using the temperature stored in said memory means so that the temperature of said recording head at resumption of the recording operation is substantially equal to the temperature of said recording head at interruption of the recording operation.

2. The image recording apparatus according to claim 1, wherein said recording head is a serial scan type.

3. The image recording apparatus according to claim 1, wherein said recording head is a full line type equipped with a plurality of recording elements along the full width of a recording area of a recording medium.

4. The image recording apparatus according to claim 1, wherein said recording head utilizes heat energy to discharge ink for recording an image and includes an electricity-heat converter for generating heat energy.

5. The image recording apparatus according to claim 1, wherein said apparatus is connected to a host computer and a recording operation is interrupted during transmission of image data form the host computer.

6. The image recording apparatus according to claim 1, wherein said temperature control means comprises a temperature sensor for detecting a temperature of said recording head, a heater for heating the recording head and a fan for cooling the recording head.

7. The image recording apparatus according to claim 6, wherein said temperature control means causes said heater to heat said recording head when the temperature detected by said sensor is lower than desired and causes said fan to cool said recording head when the detected temperature is higher than desired.

8. A method of recording an image using a recording head for performing a recording operation, the method comprising the steps of:

temporarily interrupting a normal recording operation;

detecting a temperature of said recording head when the recording operation is interrupted;

controlling a temperature of said recording head in preparation of resumption of said recording operation so that temperature of the recording head on resumption of the recording operation will be substantially equal to the temperature detected in said detecting step; and thereafter transmitting an image signal to said recording head and resuming the recording operation.

9. The method of recording an image according to claim 8, wherein said controlling step has a wait step for controlling the temperature of said recording head in accordance with a predetermined time of a recording operation interruption.

10. The method of recording an image according to claim 8, wherein said recording head is a serial scan type.

11. The method of recording an image according to claim 8, wherein said recording head utilizes heat energy to discharge ink for recording an image and includes an electricity-heat converter for generating heat energy.

12. The method of recording an image according to claim 8, wherein in said interrupting step a recording operation is interrupted during transmission of image data from a host computer.

13. The method of recording an image recording to claim 8, wherein in said controlling step said recording head is heated by a heater when the temperature detected in said detecting step is lower than desired and said recording head is cooled by a fan when the detected temperature is higher than desired.

14. An image recording apparatus comprising:

a recording head for recording an image in a normal recording operation subject to interruption and subsequent resumption;

detecting means for detecting the temperature of said recording head;

memory means for storing a temperature of said recording head when a recording operation is interrupted; and resuming means for controlling the temperature of said recording head using the temperature stored in said memory means so that the temperature of said recording head at resumption of the recording operation is close to the temperature of said recording head at interruption of the recording operation.

15. The image recording apparatus according to claim 14, further comprising temperature controlling means for controlling the temperature detected by said detecting means within a predetermined range, wherein said resuming means controls said temperature controlling means using the temperature stored in said memory means so that the temperature of said recording head at resumption of the recording operation is substantially equal to the temperature of said recording head at interruption of the recording operation.

16. The image recording apparatus according to claim 14, further comprising time counting means for counting an interruption time for the recording operation, wherein said resuming means controls application of a driving signal to said recording head using the temperature stored in said memory means and the interruption time counted by said time counting means so that the temperature of said recording head at resumption of the recording operation is substantially equal to the temperature of said recording head at interruption of the recording operation.

17. A method of recording an image using a recording head for performing a recording operation, the method comprising the steps of:

temporarily interrupting a normal recording operation;

detecting a temperature of said recording head when the recording operation is interrupted;

controlling a temperature of said recording head in preparation of resumption of the recording operation so that the temperature of the recording head on resumption of the recording operation will be close to the temperature detected in said detecting step; and thereafter transmitting an image signal to said recording head and resuming the recording operation.

18. An image recording apparatus having a stand-by mode in which a recording operation is interrupted, the apparatus, comprising:

a recording head for performing the recording operation by recording on a recording medium;

head temperature detecting means for detecting the temperature of said recording head;

memory means for storing temperature information detected by said head temperature detecting means when the apparatus is in the stand-by mode;

stand-by time counting means for counting an interruption time during which the apparatus is the stand-by mode; and head driving controlling means for providing a driving signal to said recording head, the driving signal being adapted to the temperature stored in said memory means and the interruption time counted by said stand-by time counting means at resumption of the recording operation after termination of the stand-by mode.

19. A method of recording an image using a recording head for performing a recording operation utilizing heat energy, the method comprising the steps of:

temporarily interrupting a normal recording operation performed by said recording head;

detecting a temperature of said recording head when the recording operation is interrupted;

measuring a time of the interruption of the recording operation;

transmitting a driving signal to said recording head in preparation of resumption of the recording operation in accordance with a temperature detected in said detecting step and a time measured in said measuring step at resumption of the recording operation after interruption thereof so that the temperature of said recording head on resumption of the recording operation will be substantially equal to the temperature detected in said detection step; and thereafter transmitting an image signal to said recording head and resuming the recording operation.

* * * * *

UNITED STATES PATENT AND TRADEMARK OFFICE

CERTIFICATE OF CORRECTION

PATENT NO. : 5,361,090

DATED : November 1, 1994

INVENTOR(S) : AKIO SUZUKI ET AL.

It is certified that error appears in the above-indentified patent and that said Letters Patent is hereby corrected as shown below:

COLUMN 4

Line 13, "resting" should read --resuming--.

COLUMN 5

Line 28, "graphic;" should read --graphics;--.

COLUMN 6

Line 44, "to" should read --with--.
Line 67, "resistors," should read --resistor,--.

COLUMN 10

Line 6, "one" should read --a line--.
Line 7, "110." should read --110A.--
Line 54, "an" should read --a--.

COLUMN 11

Line 50, "an" should read --a--.
Line 56, "an" should read --a--.

COLUMN 12

Line 21, "an" should read --a--.
Line 62, "an" should read --a--.

UNITED STATES PATENT AND TRADEMARK OFFICE

CERTIFICATE OF CORRECTION

PATENT NO. : 5,361,090

DATED : November 1, 1994

INVENTOR(S) : AKIO SUZUKI ET AL.

It is certified that error appears in the above-indentified patent and that said Letters Patent is hereby corrected as shown below:

COLUMN 13

Line 29, "an" should read --a--.
Line 67, "an" should read --a--.
Line 68, "resting" should read --resuming--.

COLUMN 14

Line 40, "an" should read --a--.
Line 43, "present" should read --preset--.
Line 44, "an" should read --a--.

COLUMN 15

Line 19, "an" should read --a--.
Line 45, "12" should read --S12,--.

COLUMN 16

Line 9, "an" should read --a--.
Line 31, "system." should read --systems.--.

COLUMN 18

Line 19, "form" should read --from--.
Line 39, "said" should read --the--.
Line 40, "temperature" should read --the temperature-- and "the" should read --said--.

UNITED STATES PATENT AND TRADEMARK OFFICE

CERTIFICATE OF CORRECTION

PATENT NO. : 5,361,090

DATED : November 1, 1994

INVENTOR(S) : AKIO SUZUKI ET AL.

It is certified that error appears in the above-indentified patent and that said Letters Patent is hereby corrected as shown below:

COLUMN 20

Line 7, "apparatus," should read --apparatus--.
Line 16, "is" should read --is in--.

Signed and Sealed this

Sixth Day of June, 1995

*Attest:*

Bruce Lehman

BRUCE LEHMAN

*Attesting Officer*

*Commissioner of Patents and Trademarks*